US011802019B2

(12) United States Patent
Kawakami et al.

(10) Patent No.: US 11,802,019 B2
(45) Date of Patent: Oct. 31, 2023

(54) POST-PROCESSING DEVICE

(71) Applicant: Seiko Epson Corporation, Tokyo (JP)

(72) Inventors: Kazuhisa Kawakami, Matsumoto (JP); Kazuhiro Fujita, Matsumoto (JP); Masaki Miyazawa, Matsumoto (JP); Shun Hara, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/460,579

(22) Filed: Aug. 30, 2021

(65) Prior Publication Data

US 2022/0063297 A1 Mar. 3, 2022

(30) Foreign Application Priority Data

Aug. 31, 2020 (JP) ..... 2020-145444

(51) Int. Cl.

| | |
|---|---|
| ***B41J 11/00*** | (2006.01) |
| ***B41J 13/10*** | (2006.01) |
| ***B41J 13/28*** | (2006.01) |
| ***B41J 3/44*** | (2006.01) |
| ***B65H 37/04*** | (2006.01) |
| ***B26F 1/14*** | (2006.01) |

(52) U.S. Cl.

CPC ..... *B65H 37/04* (2013.01); *B26F 1/14* (2013.01); *B41J 3/44* (2013.01); *B41J 11/0005* (2013.01); *B41J 11/0045* (2013.01); *B41J 13/106* (2013.01); *B41J 13/28* (2013.01)

(58) Field of Classification Search

CPC ..... B41J 11/0045; B41J 13/106; B41J 13/28; B41J 3/44

See application file for complete search history.

(56) References Cited

U.S. PATENT DOCUMENTS

| | | | | |
|---|---|---|---|---|
| 9,815,656 | B2 | 11/2017 | Awano | |
| 10,377,604 | B2 | 8/2019 | Awano | |
| 2009/0100976 | A1 | 4/2009 | Taguchi et al. | |
| 2009/0102112 | A1* | 4/2009 | Taguchi | B65H 35/04 271/227 |
| 2011/0229287 | A1* | 9/2011 | Suzuki | B65H 45/18 412/22 |

(Continued)

FOREIGN PATENT DOCUMENTS

| | | |
|---|---|---|
| CN | 105731172 | 7/2016 |
| JP | 2002090967 A * | 3/2002 |

(Continued)

*Primary Examiner* — Justin Seo
*Assistant Examiner* — Kendrick X Liu
(74) *Attorney, Agent, or Firm* — WORKMAN NYDEGGER

(57) ABSTRACT

A post-processing device includes a processing tray on which a medium on which recording was performed by a recording unit is loaded, a rear end alignment unit that aligns a rear end (an example of an end portion) of the medium on the processing tray, a post-processing unit that performs post-processing on the medium aligned by the rear end alignment unit, and a pressing member that presses the rear end of the medium. The post-processing unit is configured to be movable. The pressing member is provided to be rotatable in conjunction with movement of the post-processing unit, in a state in which the pressing member is in contact with the medium aligned by the rear end alignment unit.

10 Claims, 13 Drawing Sheets

(56) References Cited

U.S. PATENT DOCUMENTS

| | | | | |
|---|---|---|---|---|
| 2012/0306148 | A1* | 12/2012 | Yamagishi | B65H 3/54 271/121 |
| 2015/0123342 | A1* | 5/2015 | Furuhashi | B65H 37/04 271/220 |
| 2016/0185564 | A1* | 6/2016 | Awano | B65H 45/12 493/434 |
| 2018/0037432 | A1 | 2/2018 | Awano | |

FOREIGN PATENT DOCUMENTS

| | | | | |
|---|---|---|---|---|
| JP | 2005212991 | A | * | 8/2005 |
| JP | 2008-290844 | | | 12/2008 |
| JP | 2009-040524 | | | 2/2009 |
| JP | 2012218900 | A | * | 11/2012 |
| JP | 2012-240844 | | | 12/2012 |
| JP | 2017-132584 | | | 8/2017 |

* cited by examiner

POST-PROCESSING DEVICE

The present application is based on, and claims priority from JP Application Serial Number 2020-145444, filed Aug. 31, 2020, the disclosure of which is hereby incorporated by reference herein in its entirety.

BACKGROUND

1. Technical Field

The present disclosure relates to a post-processing device that performs post-processing on a medium such as a sheet.

2. Related Art

For example, JP-A-2017-132584 discloses, as an example of a post-processing device, a sheet processing device provided with a pressing member that presses a sheet (an example of a medium), and a stapler (an example of a post-processing unit) that performs end binding on the sheet while pressing the sheet using the pressing member. The sheet processing device is provided with a tray member (an example of a processing tray) on which the sheet is loaded, a fence member (an example of an alignment unit) that determines a position of a rear end of the sheet placed on the tray member, the pressing member that presses the sheet loaded on the tray member, and the stapler. The pressing member is configured to move in conjunction with the stapler. The pressing member presses the sheet when the stapler performs the end binding, and when the stapler moves, the pressing member separates from the sheet and moves together with the stapler.

However, in the post-processing device disclosed in JP-A-2017-132584, since the pressing member separates from the medium when the post-processing unit moves, when the medium that is curled has been pressed, during the separation, due the curl of the medium, a thickness of a bundle of a plurality of the sheets expands. Then, when the post-processing, such as the end binding, is performed in this expanded state, there is a problem that the quality of the post-processing deteriorates. Thus, there is a demand to perform the post-processing without error on a media bundle in which a plurality of the sheets are bundled together, even when the medium has curled. This type of demand is not limited to the end binding, and the same demand applies to post-processing such as punching, center binding, or the like. For example, when post-processing, such as the end binding, is performed on the medium on which a recording device has performed printing using an inkjet recording method, the medium is likely to curl during the post-processing. This is because, due to expansion of the medium occurring in the course of the ink being absorbed into the medium, and contraction of the medium occurring in the course of the ink absorbed by the medium drying, the medium is likely to curl. Further, the above-described problem also occurs in cases where the post-processing is performed on the medium on which recording has been performed using a recording method other than the inkjet recording method or on the medium on which pre-processing has been performed other than the recording, and in cases where there is a possibility that the medium is curled at the time of the post-processing, such as when using the medium that has a tendency to curl up.

SUMMARY

A post-processing device for solving the above-described problem includes a processing tray at which is loaded a medium on which recording was performed by a recording unit, an alignment unit configured to align an end portion of the medium at the processing tray, a post-processing unit configured to perform post-processing on the medium aligned by the alignment unit, and a pressing member configured to press the end portion of the medium. The post-processing unit is configured to move, and the pressing member is configured to move in conjunction with the movement of the post-processing unit, in a state where the pressing member is in contact with the medium aligned by the alignment unit.

DESCRIPTION OF EXEMPLARY EMBODIMENTS

First Embodiment

A recording system according to a first embodiment will be described below with reference to the drawings. The recording system performs a post-processing operation in which a plurality of recorded media are stacked and post-processing is performed on a bundle of the stacked media. In advance of the post-processing operation, the recording system may perform a recording operation of performing recording on the medium such as a sheet, for example.

Figure 1:
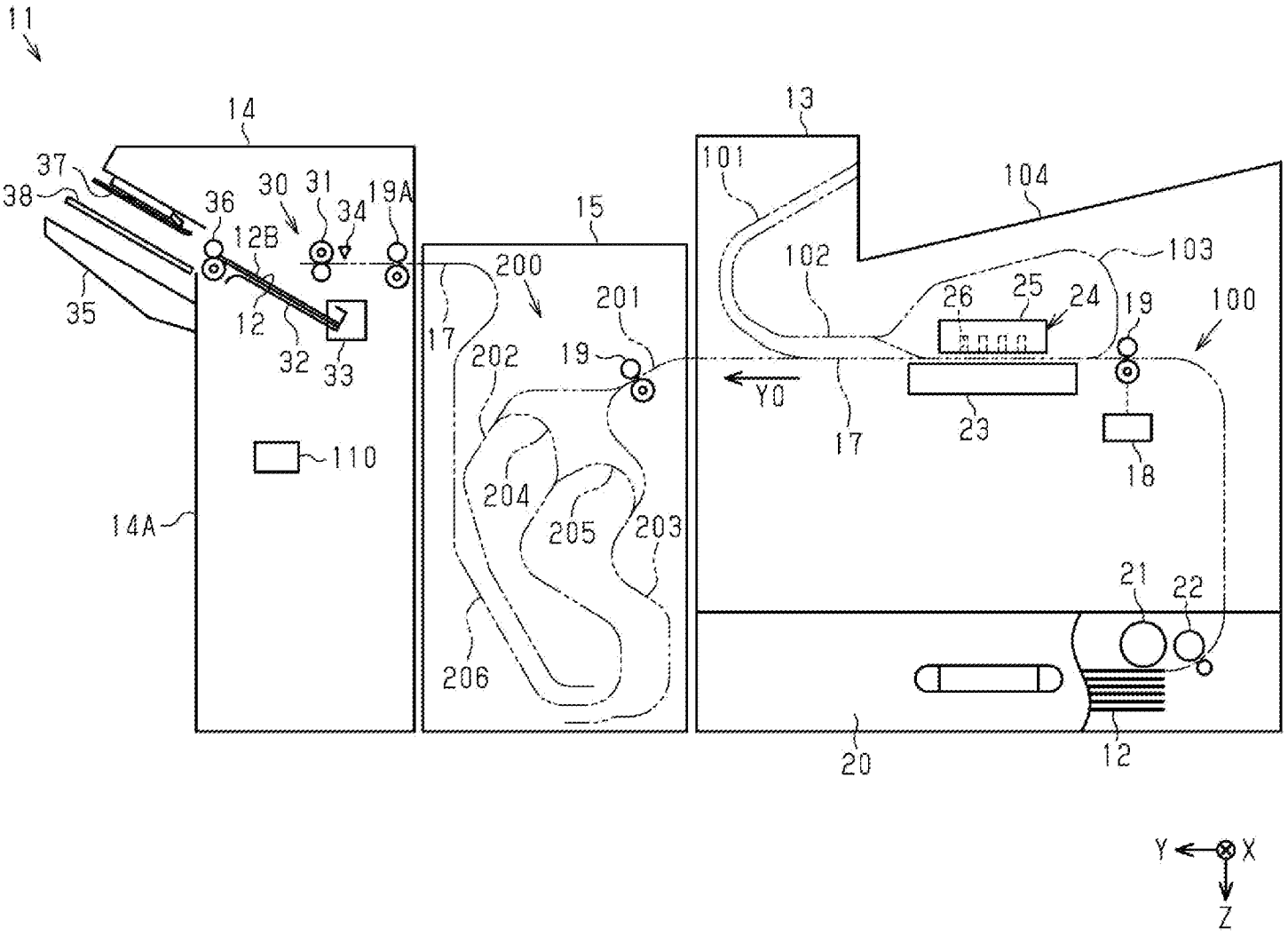
FIG. 1 is a schematic cross-sectional side view illustrating a recording system provided with a post-processing device according to a first embodiment.

In FIG. 1, assuming that a recording system 11 is placed on a horizontal surface, the direction of gravity is indicated by a Z-axis, and two mutually intersecting axes along a plane intersecting the Z-axis are indicated by an X-axis and a Y-axis. The X-axis, the Y-axis, and the Z-axis are preferably orthogonal to each other. In the following description, a direction parallel to the X-axis is also referred to as a width direction X, the direction of gravity parallel with the Z-axis is also referred to as a vertical direction Z, and a direction orthogonal to the width direction X along a transport path 17 is referred to as a transport direction Y0. The transport direction Y0 is the direction in which transport roller pairs 19, 19A, and 31 transport a medium 12, and changes depending on the position of the medium 12 transported from a recording device 13 toward a post-processing device 14.

As illustrated in FIG. 1, the recording system 11 is provided with the post-processing device 14 for processing the recorded medium 12. Note that the recording system 11 may also include the recording device 13 that performs the recording on the medium, and may further include an intermediate device 15 disposed between the recording device 13 and the post-processing device 14. The recording device 13 is, for example, an inkjet-type printer that records characters or an image by discharging ink, which is an example of a liquid, onto the medium 12. The intermediate device 15 internally inverts the recorded medium 12 transported from the recording device 13 and then discharges the medium 12 to the post-processing device 14. The post-processing device 14 performs post-processing on the medium 12 that has been recorded and transported from the intermediate device 15. The post-processing is, for example, stapling processing or the like in which a plurality of the media 12 are bound. Note that, in addition to the stapling processing, the post-processing may be punching processing, center-binding processing, folding processing, or the like. Here, the punching processing is processing for forming a punch hole in one or a plurality of the media 12.

The recording system 11 is provided with the transport path 17, which is illustrated by a two-dot chain line in FIG. 1, which extends from the recording device 13 through the intermediate device 15 and into the post-processing device 14. The recording device 13 includes one or a plurality of the transport roller pairs 19 that transport the medium 12 along the transport path 17 as a result of being driven by a transport motor 18. Further, the intermediate device 15 is provided with an inversion processing unit 200 that inverts the recorded medium 12. The intermediate device 15 is provided with a transport motor (not illustrated) that drives the one or the plurality of transport roller pairs 19 configuring the inversion processing unit 20.

Further, the recorded medium 12 inverted by the intermediate device 15 is transported into the post-processing device 14. The post-processing device 14 is provided with a transport mechanism 30 that transports the medium 12. The transport mechanism 30 is provided with the transport roller pairs 19A and 31 and a transport motor (not illustrated) that drives the transport roller pairs 19A and 31.

The post-processing device 14 is provided with a processing tray 32 onto which the medium 12 transported from the transport roller pair 31 is loaded, a post-processing unit 33 that performs the post-processing on the medium 12 that has been aligned on the processing tray 32, a discharge mechanism 36 that discharges the medium 12 from the processing tray 32 after the post-processing, and a discharge tray 35 onto which the medium 12 discharged from the discharge mechanism 36 is loaded. The medium 12 recorded by a recording unit 24 is loaded onto the processing tray 32.

Further, the post-processing device 14 may be provided with a guide member 37 that guides, from above, a media bundle 12B discharged by the discharge mechanism 36 to a position above the discharge tray 35, and medium supporting members 38 that temporarily support the media bundle 12B in the process of being discharged, and then drop the media bundle 12B onto the discharge tray 35. The post-processing device 14 may be provided with a raising/lowering mechanism that lowers the discharge tray 35 as a loaded amount of the media 12 on the discharge tray 35 increases.

Note that the media bundle 12B refers to a bundle of the plurality of the media 12 that are stacked in a state in which the ends thereof are aligned. Further, the post-processing is processing performed on the single medium 12 or on the media bundle 12B, and is processing that is performed after pre-processing, on the medium 12 or the media bundle 12B on which the pre-processing, such as the recording or the inversion processing, has been performed.

Next, a detailed configuration of the recording device 13 will be described. One or a plurality of cassettes 20 that house the media 12 in a stacked state are detachably provided on the recording device 13. The recording device 13 is provided with a pickup roller 21 that feeds out the uppermost medium 12 of the media 12 housed in the cassette 20, and a separating roller 22 that separates the medium 12 fed out by the pickup roller 21 and feeds out only the one medium 12. The single fed medium 12 is transported along the transport path 17.

The recording device 13 is provided with a support unit 23 that is provided at a position along the transport path 17 and supports the medium 12, and the recording unit 24 that is provided at a position facing the support unit 23 with the transport path 17 interposed therebetween. The recording unit 24 is provided with a liquid discharge head 25 including a plurality of nozzles 26 capable of discharging a liquid. The liquid discharge head 25 performs recording on the medium 12 by discharging the liquid, such as ink, from the nozzles 26 toward a section of the medium 12 supported by the support unit 23. The liquid discharge head 25 is, for example, a line head. The line head can simultaneously discharge the liquid over a range spanning the entire width direction X of the medium 12, using a large number of the nozzles 26 disposed at a constant nozzle pitch over the range spanning the entire width direction X of the medium 12. Note that the recording unit 24 may adopt a serial recording method. In the case of the serial recording method, the recording unit 24 is provided with a carriage (not illustrated) that can move in the width direction X, and a serial type liquid discharge head 25 provided on the carriage, The liquid discharge head 25 discharges the liquid from the nozzles 26 toward the medium 12 while moving in the width direction X along with the carriage.

As illustrated in FIG. 1, the recording device 13 is provided with a transport unit 100 that transports the medium 12. As part of the transport path 17, the transport unit 100 is provided with a discharge path 101 through which the medium 12 is discharged, a switchback path 102 in which the medium 12 is switched back and transported, and an inversion path 103 in which front and back sides of the medium 12 are inverted. The switchback path 102 and the inversion path 103 are used when double-sided recording is performed. In the double-sided recording, by switching back and transporting, in the switchback path 102, the medium 12 on a first surface of which the recording has been performed, the medium 12 is fed from the rear end thereof into the inversion path 103 and is inverted therein. After that, the medium 12 is once more supplied toward the liquid discharge head 25. The liquid discharge head 25 performs the recording on a second surface of the medium 12, the second surface being the surface on the opposite side from the first surface, and the double-sided recording is thus performed on the medium 12. The medium 12 on which the recording is performed, by the liquid discharge head 25, on one side or both sides thereof is discharged to a discharge unit 104 through the discharge path 101, or is transported to the intermediate device 15.

Note that, when the recording device 13 is the inkjet printer, the recording is performed by discharging the liquid such as the ink or the like onto the medium 12. The recorded medium 12 absorbs the ink deposited on the recording surface thereof. As a result of absorbing the ink, the recording surface side of the medium 12 swells more than the back surface side. Fibers of a section into which the ink has permeated and which has swelled become stretched, and thus, the recording surface side stretches significantly more than the back surface side thereof. Thus, the medium is likely to curl in a manner in which the recording surface side protrudes. On the other hand, when the ink permeates into the back surface of the medium, the back surface side also swells and stretches due to the absorbed ink, and thus, an ink density distribution in the thickness direction becomes small. In other words, the front and back sides of the medium stretch together, and thus the curl is somewhat suppressed. The permeation of the ink into the back surface depends on a discharge amount of the ink per unit area and the thickness of the medium. The greater the discharge amount of the ink per unit area, or the thinner the thickness of the medium, the more curl is likely to occur.

On the other hand, when the medium 12 dries from the state of being swollen due to the ink, the swollen section of the medium 12 shrinks significantly compared to a section that is not swollen. For example, when the recording surface side is significantly swollen, the recording surface side shrinks significantly compared to the back surface side, and thus the recording surface side curls in a concave shape. Further, in the case of the double-sided recording, the discharge amount of the ink per unit area differs between the front surface and the back surface, and thus, the surface with the greater discharge amount of the ink per unit area tends to curl in the concave manner. Further, thick paper such as photographic paper, coated paper, or the like has a coating layer applied to the front surface thereof, and thus, the ink is less likely to permeate into the medium 12. Thus, curling is unlikely to occur due to the medium thickness and the low ink permeability.

As described above, in the case of the inkjet printer, when the discharge amount of the ink per unit area is large, and when the thickness of the medium 12 is thin, the medium 12 that has not been subjected to a coating treatment, such as plain paper, tends to easily curl. In this way, compared to a recording device using another recording method, the inkjet printer uses a recording method in which the recorded medium 12 is likely to curl.

As illustrated in FIG. 1, the intermediate device 15 includes the above-described inversion processing unit 200 that inverts the recorded medium 12 transported from the recording device 13. The inversion processing unit 200 includes an introduction path 201, a first switchback path 202, a second switchback path 203, a first convergence path 204, a second convergence path 205, and a delivery path 206. The inversion processing unit 200 includes the plurality of transport roller pairs 19 (only one of which is illustrated) that transport the medium 12 along each of the paths 201 to 206, and flaps (not illustrated) that guide the medium 12 to one of transport destinations, at branching locations of each of the paths 201 to 203. After passing through the introduction path 201, the destination of the medium 12 is alternately switched between the first switchback path 202 and the second switchback path 203 by the flap.

The medium 12 switched back and transported in the first switchback path 202 is transported to the delivery path 206 after being inverted in the first convergence path 204. On the other hand, the medium 12 switched back and transported in the second switchback path 203 is transported to the delivery path 206 after being inverted in the second convergence path 205. The inverted medium 12 is delivered from the intermediate device 15 through the delivery path 206 to the post-processing device 14 in an orientation in which the surface recorded immediately previously by the recording device 13 is oriented downward. Further, the drying of the medium 12 progresses during the process of transporting the medium 12 through the interior of the intermediate device 15, and the medium 12 in which the curl or the like caused by moisture or the like in the ink attached to the medium 12 is suppressed, is delivered to the post-processing device 14.

The recording device 13 controls the transport unit 100 and the recording unit 24 using a control unit (not illustrated). Further, the post-processing device 14 is provided with a control unit 110. The control unit 110 controls the driving of the transport mechanism 30, the post-processing unit 33, the discharge mechanism 36, the guide member 37, the medium supporting members 38, and the like. Note that the control unit 110 may also control the intermediate device 15. The control unit of the recording device 13 may also serve as the control unit 110 of the post-processing device 14.

Next, the configuration of the post-processing device 14 will be described in detail with reference to FIG. 1 to FIG. 3.

As illustrated in FIG. 1, the medium 12 inverted by the intermediate device 15 is transported into a housing 14A of the post-processing device 14. The medium 12 transported into the housing 14A is transported by the above-described transport mechanism 30, and is then discharged substantially horizontally into a space (a processing region) above the processing tray 32. In other words, when viewed from the processing tray 32 side, the medium 12 is transported substantially horizontally from the transport mechanism 30 into the space above the processing tray 32. The transport mechanism 30 is provided with a sensor 34 that detects the presence or absence of the medium 12 at a position on the transport path between the transport roller pair 19A and the transport roller pair 31. The sensor 34 senses the leading end and the rear end, in the transport direction Y0, of the medium 12. Based on a detection position at which the sensor 34 has detected the rear end of the medium 12, the control unit 110 detects a timing at which the rear end of the medium 12 separates from the transport roller pair 31 of the transport mechanism 30. When the rear end of the medium 12 separates from the transport roller pair 31, the control unit 110 starts alignment control for loading the medium 12 on the processing tray 32 in an aligned state.

Figure 2:
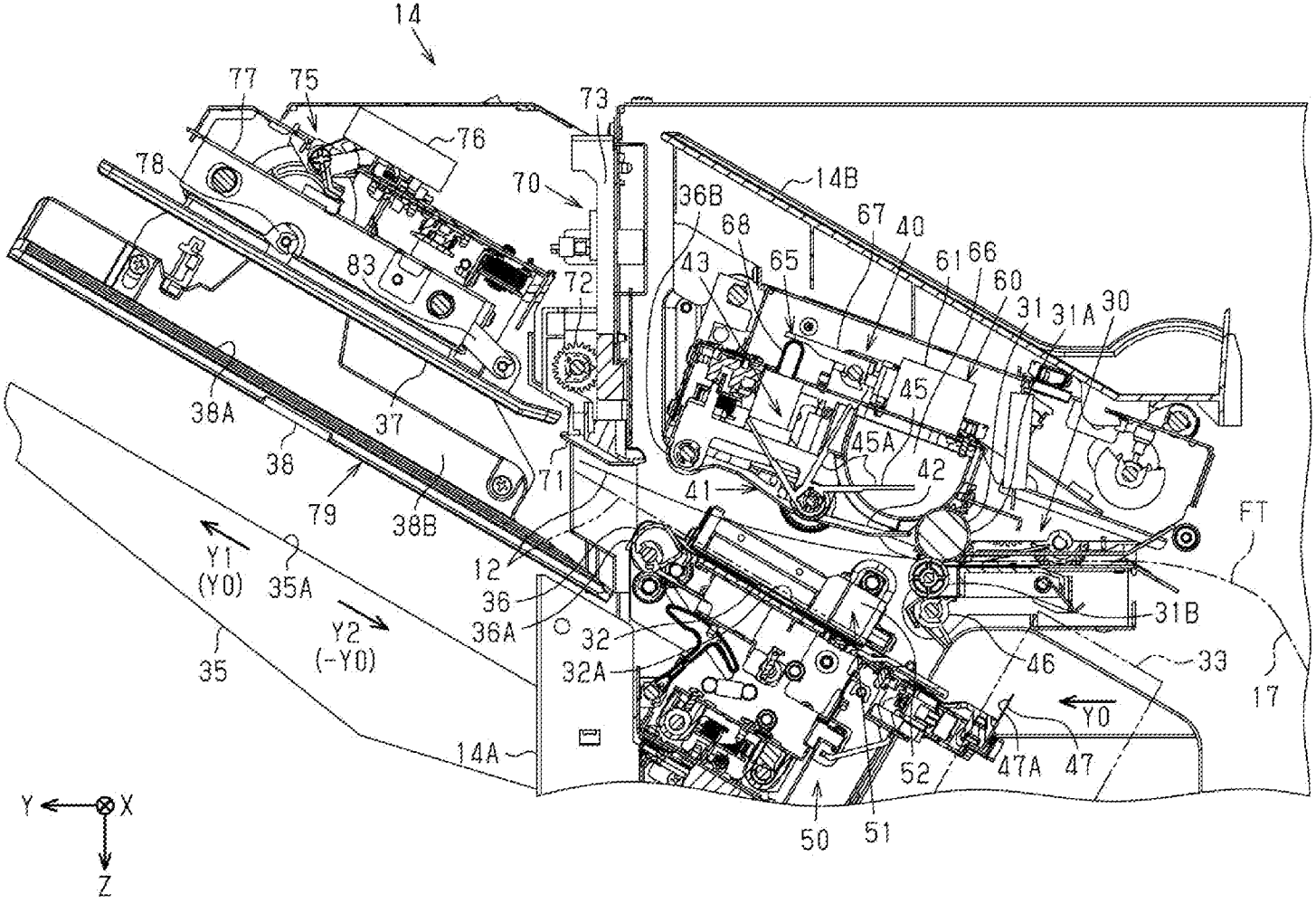
FIG. 2 is a side cross-sectional view illustrating main portions of the post-processing device.

As illustrated in FIG. 2, the post-processing device 14 may be provided with the transport mechanism 30, the processing tray 32, a receiving mechanism 41, a feeding mechanism 43, a alignment mechanism 51, the discharge mechanism 36, a pushing-down mechanism 70, a guide mechanism 75, and a supporting mechanism 79.

The transport mechanism 30 is provided with the above-described transport roller pair 31 at a downstream end portion thereof in the transport direction Y0. The transport roller pair 31 is configured by a driving roller 31A and a driven roller 31B. The medium 12 is transported substantially horizontally from the transport roller pair 31 into the processing region above the processing tray 32.

The post-processing device 14 is provided with a receiving unit 40 positioned on an upper side and an alignment unit 50 positioned on a lower side, on either side in the vertical direction Z of the transport path of the medium 12 transported substantially horizontally from the transport mechanism 30. The processing tray 32 is fixed to the upper end of the alignment unit 50 in an oblique posture. The receiving unit 40, which rotatably supports a first paddle 45, is disposed above the processing tray 32.

Note that, as illustrated in FIG. 2, the post-processing device 14 may include a discharge surface 14B onto which the recorded medium transported via another transport path (not illustrated) is discharged, separately from a transport path FT along which the medium 12 forming the media bundle 12B is transported. The discharge surface 14B is located above the receiving unit 40 and is positioned at a height that allows a user to easily pick up the medium. For example, the medium 12 on which an image is recorded that has been received in the form of a facsimile by the recording device 13 is discharged onto the discharge surface 14B.

The processing tray 32 illustrated in FIG. 2 includes a loading surface 32A onto which the medium 12 is loaded. The loading surface 32A is an inclined surface of which the downstream end in the transport direction Y0 is lower than the upstream end, with respect to the vertical direction Z. The processing tray 32 has a predetermined width dimension that is longer than the width of the medium 12 having the maximum width in the width direction X. Note that, depending on the inclination of the loading surface 32A of the processing tray 32, the transport direction Y0 in which the media bundle 12B is discharged from the loading surface 32A is referred to as a first transport direction Y1 and a direction opposite to the first transport direction Y1 is referred to as a second transport direction Y2 (−Y0). In other words, the first transport direction Y1 is equivalent to the transport direction Y0 of the medium 12 on the loading surface 32A, and the second transport direction Y2 is equivalent to a reverse transport direction −Y0 that is the opposite direction to the transport direction Y0 of the medium 12 on the loading surface 32A.

The receiving unit 40 includes the receiving mechanism 41 and a part of the feeding mechanism 43. The receiving mechanism 41 guides the medium 12, which is transported substantially horizontally from the transport roller pair 31, onto the processing tray 32 that is inclined with respect to the horizontal direction. The medium 12 guided by the receiving mechanism 41 is more easily received on the processing tray 32. The receiving mechanism 41 includes a rotating variable guide 42.

The variable guide 42 illustrated in FIG. 2 rotates within a predetermined angle range about the downstream end portion thereof in the transport direction Y0. The variable guide 42 rotates between a standby position illustrated in FIG. 2 and an operating position (not illustrated) at which the variable guide has rotated from the standby position in FIG. 2 by a predetermined angle in the clockwise direction. The tip of the variable guide 42 in the standby position is positioned above and in the vicinity of a receiving entrance of the transport roller pair 31. Further, the variable guide 42 is also positioned at a central portion in the width of the receiving unit 40 (see FIG. 3). As a result of the variable guide 42 rotating in the clockwise direction in FIG. 2 from the standby position toward the operating position, the variable guide 42 performs an operation of downwardly tapping a central portion in the width of the medium 12 that is indicated by a solid line in FIG. 2 and that is being transported substantially horizontally at a predetermined transport speed from the transport roller pair 31. As a result of the variable guide 42 tapping the medium 12 downward, the path of the medium 12 is changed to a direction along the loading surface 32A of the processing tray 32, and the medium 12 is received in the processing tray 32. Note that a plurality of the variable guides 42 may be provided at different positions in the width direction X.

As illustrated in FIG. 2, the receiving unit 40 is configured by assembling the variable guide 42 and a drive mechanism 65 thereof, and the first paddle 45 and a drive mechanism 60 thereof, of the feeding mechanism 43, on a frame. The variable guide 42 is rotationally displaced by the drive mechanism 65. Further, the first paddle 45 is rotationally driven by the drive mechanism 60.

As illustrated in FIG. 2, the drive mechanism 65 of the variable guide 42 includes an electric motor 66, a drive lever 67 driven by the power of the electric motor 66, and a driven portion 68 that is displaced by being pressed downward by the drive lever 67. The driven portion 68 is urged upward by a spring (not illustrated), and is displaced downward as a result of being pressed by the drive lever 67. When the driven portion 68 is displaced downward, the variable guide 42 rotates from the standby position illustrated in FIG. 2 to the operating position that is inclined downward by a predetermined angle. When the drive lever 67 returns to a position at which the drive lever 67 does not press the driven portion 68, due to the urging force of the spring, the variable guide 42 rotates from the operating position to the retracted position. This reciprocating rotation of the variable guide 42 causes the medium 12 transported from the transport roller pair 31 to be tapped downward.

The feeding mechanism 43 has a function of feeding the medium 12 guided to the processing tray 32 by the receiving mechanism 41 in the second transport direction Y2 along the inclined loading surface 32A. At a position above the processing tray 32, the feeding mechanism 43 includes the above-described first paddle 45 having a large diameter, and a second paddle 46 having a smaller diameter. The large diameter first paddle 45 is disposed above a position upstream of the loading surface 32A of the processing tray 32 in the second transport direction Y2. The small diameter second paddle 46 is disposed above a position downstream of the loading surface 32A of the processing tray 32 in the second transport direction Y2. The first paddle 45 includes a plurality of blade portions 45A.

The first paddle 45 is rotationally driven by the drive mechanism 60. The drive mechanism 60 includes an electric motor 61, which is a drive source of the first paddle 45. The first paddle 45 moves in the width direction X as a result of a transmission force generated by the power of the electric motor 61 being transmitted through a power transmission mechanism (not illustrated). Further, the first paddle 45 rotates in the counterclockwise direction in FIG. 2 due to rotation of a rotary shaft 48 (see FIG. 3) under the power of an electric motor (not illustrated). Further, the second paddle 46 rotates in the counterclockwise direction in FIG. 2 due to rotation of a rotary shaft 49 (see FIG. 3) under the power of an electric motor (not illustrated).

After the rear end of the medium 12 has been detected by the sensor 34, when the driving roller 31A finishes rotating by a rotation amount corresponding to a distance between the sensor 34 and a nip position of the transport roller pair 31, the control unit 110 illustrated in FIG. 1 drives the electric motor 66 illustrated in FIG. 2. In this way, at the timing at which the rear end of the medium 12 separates from the transport roller pair 31, the variable guide 42 rotates from the retracted position to the operating position. Thus, the medium 12 transported substantially horizontally into the processing region above the processing tray 32 is tapped downward by the variable guide 42 at the timing at which the nipping of the medium 12 by the transport roller pair 31 is released, and the transport path of the medium 12 is changed to the direction along the processing tray 32.

Further, the first paddle 45 begins to rotate at a timing at which the variable guide 42 taps the medium 12 downward. The medium 12 is guided to the processing tray 32 by the tapping action of the variable guide 42 and the rotating action of the first paddle 45. The first paddle 45 and the second paddle 46 come into contact with the medium 12 at different positions in the second conveyance direction Y2 while rotating, and thus draw the medium 12 in the second transfer direction Y2. The first paddle 45 and the second paddle 46 may feed the medium 12 in the second conveyance direction Y2 at the same feed rate. Further, the first paddle 45 may feed the medium 12 by a large feed amount and, when the feeding of the first paddle 45 ends, the second paddle 46 may feed the medium 12 by a small feed amount.

Figure 3:
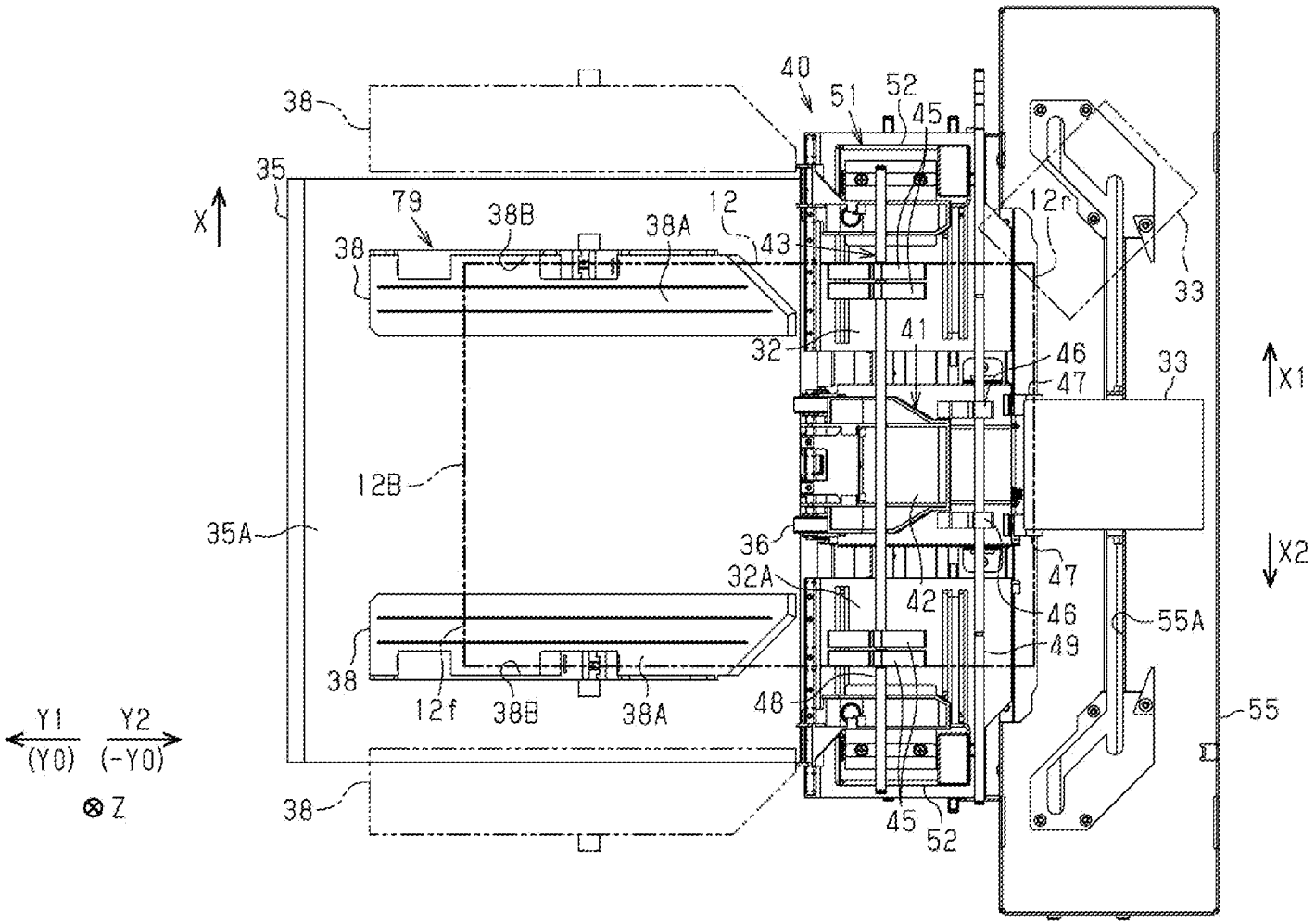
FIG. 3 is a plan view illustrating the main portions of the post-processing device.

As illustrated in FIG. 2 and FIG. 3, the post-processing device 14 includes a rear end alignment unit 47, which is an example of an alignment unit that aligns a rear end 12*r* of the medium 12 in the processing tray 32. The rear end alignment unit 47 is bent into a predetermined shape from the end portion in the second transport direction Y2 of the processing tray 32, and extends upward. The rear end alignment unit 47 includes a regulating surface 47A that is orthogonal to the loading surface 32A as seen in a side view in FIG. 2.

The paddles 45 and 46 feed the medium 12 on the processing tray 32 until the rear end 12*r* thereof (see FIG. 3) comes into contact with the rear end alignment unit 47. The medium 12 fed in the second transport direction Y2 by the paddles 45 and 46 is aligned with the transport direction Y0 in the processing tray 32 as a result of the rear end 12*r* thereof colliding with the rear end alignment unit 47, with a position of that collision acting as a reference. A plurality of the rear end alignment units 47 are provided at intervals in the width direction X. The interval between the plurality of rear end alignment units 47 is set to a length that allows a minimum width of the medium 12 to collide therewith at a plurality of locations. The post-processing unit 33 performs the post-processing on the medium 12 aligned by the rear end alignment units 47. The post-processing unit 33 of the present example is provided so as to be movable in the width direction X, and performs the post-processing, such as the stapling processing or the like, with respect to a rear end 12R of the media bundle 12B at positions avoiding the plurality of rear end alignment units 47 in the width direction X.

As illustrated in FIG. 2 and FIG. 3, the post-processing device 14 may be provided with the alignment mechanism 51 to align the medium 12 in the width direction X in the processing tray 32. In other words, in the processing tray 32, in addition to the transport direction Y0, the medium 12 may also be aligned in the width direction X. The alignment mechanism 51 is provided with a pair of alignment members 52 that can move in the width direction X along the loading surface 32A of the processing tray 32. The alignment mechanism 51 is provided with two electric motors (not illustrated) serving as drive sources that individually drive the pair of alignment members 52. The pair of alignment members 52 perform alignment in the width direction X to align the medium 12 in the width direction X, by tapping both side edges of the medium 12 once or a plurality of times, at a timing at which the first paddle 45, which intermittently comes into contact with the medium 12, is separated from the medium 12. In this way, on the processing tray 32, the medium 12 is aligned in the two directions of the second transport direction Y2 and the width direction X.

The media 12 are sequentially loaded onto the processing tray 32. The aligned media bundle 12B is formed on the processing tray 32 in a state in which the plurality of media 12 are aligned with each other. When a number of the media 12 loaded on the processing tray 32 reaches a target number, the post-processing unit 33 performs the post-processing on the media bundle 12B on the processing tray 32. In the processing tray 32, the media 12 are at least aligned in the transport direction Y0. At this point, the post-processing unit 33 performs the post-processing on the media 12 that have been aligned by the rear end alignment units 47. Note that the target number is not limited to a plurality of the media 12, and may include the one medium 12.

The post-processing unit 33 of the present example can move in the width direction X. Here, the width direction X is a direction intersecting the transport direction Y0 of the medium 12 in the processing tray 32. The width direction X is a direction parallel to the direction in which the edge of the rear end 12*r* of the medium 12 aligned by the rear end alignment units 47 extends. Thus, the post-processing unit 33 can move along the rear end 12*r* of the medium 12 aligned by the rear end alignment units 47, by moving in the width direction X. The post-processing unit 33 moves along the rear end 12*r* of the medium 12, and performs the post-processing at one or a plurality of target positions on the rear end of the media bundle 12B.

The post-processing unit 33 is, for example, a stapling mechanism (a stapler). When the post-processing unit 33 is the stapler, the post-processing unit 33 moves in the width direction X as necessary, and performs the stapling processing at one location or a plurality of locations on the rear end of the media bundle 12B. The post-processing unit 33 is not limited to the stapler, and may be a punching mechanism (a puncher), a folding mechanism, or a perforation mechanism that forms perforations. The punching mechanism performs processing in which a hole (a punch hole) is formed in the rear end of the medium 12. The folding mechanism is a mechanism that imparts a fold to the medium. With any one of these mechanisms, the post-processing unit 33 moves in the width direction X to the target position in the same manner as the stapling mechanism, and performs any one of the punching processing, the folding processing, and perforation processing on the rear end of the media bundle 12B.

As illustrated in FIG. 3, a stage 55 serving as a movement base when the post-processing unit 33 moves in the width direction X is disposed at a position adjacent to the processing tray 32, upstream in the transport direction Y0. The post-processing unit 33 is provided so as to be movable in a first direction X1 and a second direction X2 along a guide groove 55A formed in the stage 55. The post-processing unit 33 may be guided to a section bent at a predetermined angle at an end of the guide groove 55A, and a posture thereof may be inclined at an angle of approximately 45 degrees so as to be disposed in an inclined posture indicated by a two-dot chain line in FIG. 3. In this case, the post-processing unit 33 is configured to be able to perform parallel stapling for binding a staple pin in an orientation parallel to the edge of the rear end of the media bundle 12B, and also to be able to perform oblique stapling for stapling the staple pin at a diagonally inclined angle (45 degrees, for example) in a corner of the media bundle 12B. Note that when the width size of the media bundle 12B varies, a configuration may be adopted in which, by moving the media bundle 12B in the width direction X using the medium supporting members 38 and the alignment mechanism 51, the corner of the media bundle 12B is shifted to a position at which the oblique stapling by the post-processing unit 33 is possible.

The discharge mechanism 36 illustrated in FIG. 2 and FIG. 3 is provided at the downstream end of the processing tray 32 in the transport direction Y0, and discharges the media bundle 12B after the post-processing from the processing tray 32 toward the discharge tray 35. The discharge mechanism 36 employs, for example, a roller discharge method. As illustrated in FIG. 2, the discharge mechanism 36 includes a roller pair formed of a driving roller 36A and a driven roller 36B that are able to clamp the media bundle 12B on the processing tray 32. In the present example, the driven roller 36B is axially supported on the base end of the variable guide 42. The driven roller 36B moves between a separated position illustrated in FIG. 2 of being separated from the driving roller 36A, and a nip position (not illustrated) where the media bundle 12B can be nipped between the driven roller 36B and the driving roller 36A. The movement of the driven roller 36B between the nip position and the separated position is performed as a result of the receiving unit 40 changing the posture by rotating around a rotational fulcrum (not illustrated). The driven roller 36B is urged in a direction approaching the driving roller 36A by a spring (not illustrated). Note that the discharge mechanism 36 is not limited to the roller transport method, and may be an ejection method including a pusher that ejects the media bundle 12B placed on the processing tray 32 from the processing tray 32.

The guide mechanism 75 including the guide member 37 is provided at a position above the discharge tray 35 (see FIG. 1). Using the guide member 37, the guide mechanism 75 guides the media bundle 12B discharged from the processing tray 32 by the discharge mechanism 36 such that the media bundle 12B is not displaced upward. The guide mechanism 75 includes an electric motor 76, which is a drive source, and a drive mechanism 77. Two output shafts of the drive mechanism 77 are coupled to the guide member 37 via arms 78. As a result of the driving of the electric motor 76, a position of the guide member 37 is adjusted in a direction that changes a space between the supporting members 38 and the guide portion 37. The position of the guide member 37 may be adjusted depending on the thickness of the media bundle 12B and an amount of curl of the media bundle 12B.

Further, the pushing-down mechanism 70 is provided at a position between the processing tray 32 and the guide member 37 in the transport direction Y0. The pushing-down mechanism 70 is provided with a pushing member 71 that pushes down the medium 12. The pushing-down mechanism 70 is provided with a drive source (not illustrated), a pinion 72 that is rotated by the power of the drive source, and a rack member 73 that meshes with the pinion 72. The pushing member 71 is fixed to the lower end of the rack member 73. As a result of the pushing member 71 pushing the rear end of the discharged media bundle 12B downward, the rear end of the media bundle 12B is inhibited from becoming caught on the driving roller 36A or on a location near the driving roller 36A, and thus not dropping onto the loading surface 35A of the discharge tray 35.

As illustrated in FIG. 2 and FIG. 3, the supporting mechanism 79 includes the pair of medium supporting members 38 (only one of which is illustrated in FIG. 2) disposed at a position between the guide member 37 and the discharge tray 35 (see FIG. 1). The pair of medium supporting members 38 are positioned above the discharge tray 35 and are provided so as to be movable in the width direction X. Each of the pair of medium supporting members 38 includes a supporting surface 38A that supports a lower surface (back surface) of the media bundle 12B, and a guide surface 38B that guides the side edge of the media bundle 12B.

As illustrated in FIG. 3, the pair of medium supporting members 38 move in the width direction X between a holding position (illustrated by solid lines in FIG. 3), in which the medium 12 can be held by the pair of supporting surfaces 38A, and a retracted position (illustrated by a two-dot chain line in FIG. 3, for example), in which the pair of medium supporting members 38 are separated in the width direction X such that the media bundle 12B cannot be held by the pair of supporting surfaces 38A. In a state in which the pair of medium supporting members 38 are disposed in the holding position, a tip portion of the medium 12 loaded on the processing tray 32 is supported by the pair of supporting surfaces 38A, and is guided by the pair of guide surfaces 38B, and a deviation in the width direction X of the medium 12 is suppressed within an acceptable range.

The pair of medium supporting members 38 support the tip portion of the medium 12 loaded on the processing tray 32, thus suppressing sagging of the tip portion. When the media bundle 12B is discharged in a state in which the tip portion of the media bundle 12B is sagging, there is a risk that the sagging tip portion may be rolled inward and folding over may occur. The pair of medium supporting members 38 prevent the sagging that causes this type of folding over. After holding the medium 12 to a point partway through the discharge process of the medium 12 from the processing tray 32, the pair of medium supporting members 38 drop the media bundle 12B onto the discharge gray 35 by retracting in the width direction X to the retracted position.

Next, a detailed configuration of the post-processing unit 33 will be described with reference to FIG. 4.

Figure 4:
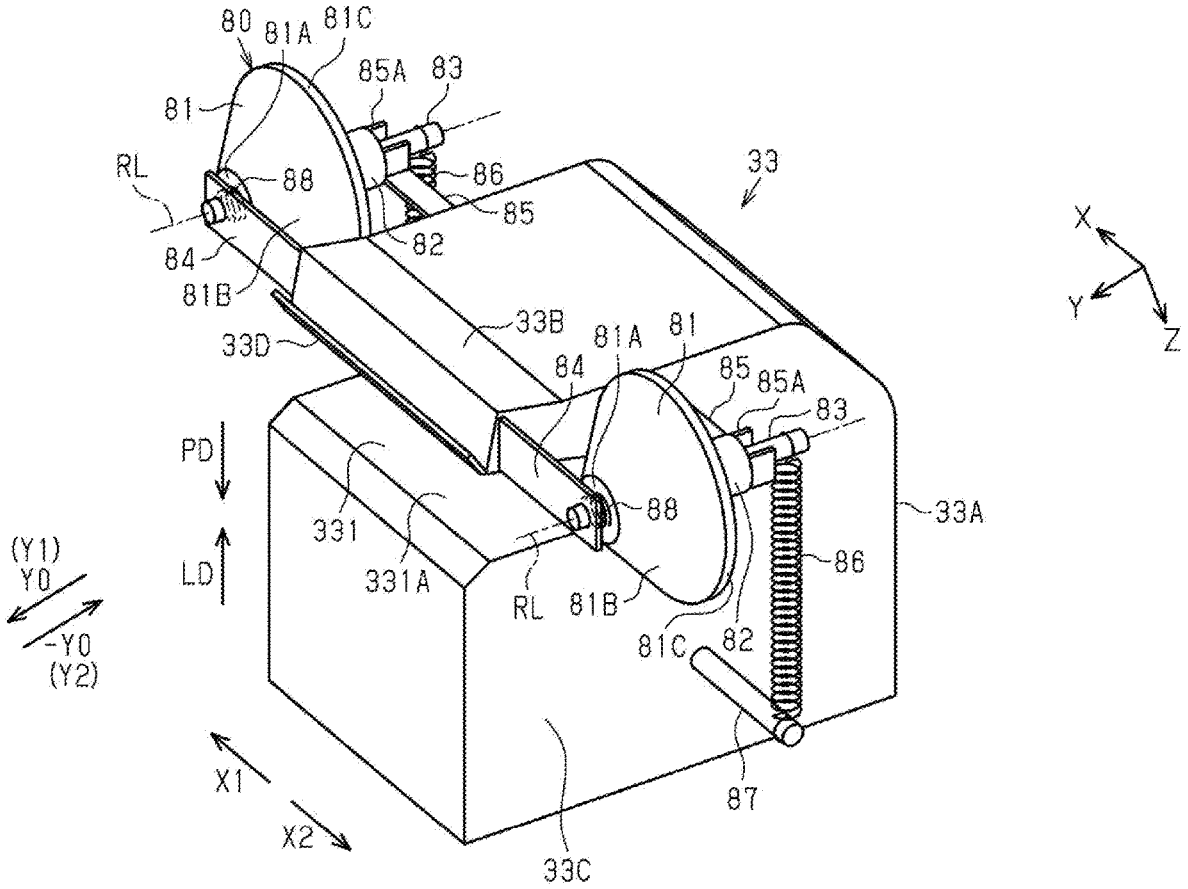
FIG. 4 is a perspective view illustrating a post-processing unit and a pressing mechanism.

As illustrated in FIG. 4, the post-processing unit 33 includes a main body 33A having a cuboid shape and a pressing mechanism 80 that presses the rear end of the medium 12. The pressing mechanism 80 includes a pressing member 81 that presses the rear end of the medium 12. The pressing member 81 presses a section of the rear end of the media bundle 12B at which the post-processing is performed by the post-processing unit 33. In the present example, the medium 12, onto which the liquid such as the ink or the like has attached as a result of being discharged by the recording unit 24, is likely to curl. Then, the post-processing is performed on the medium 12 that is likely to curl.

Figure 5:
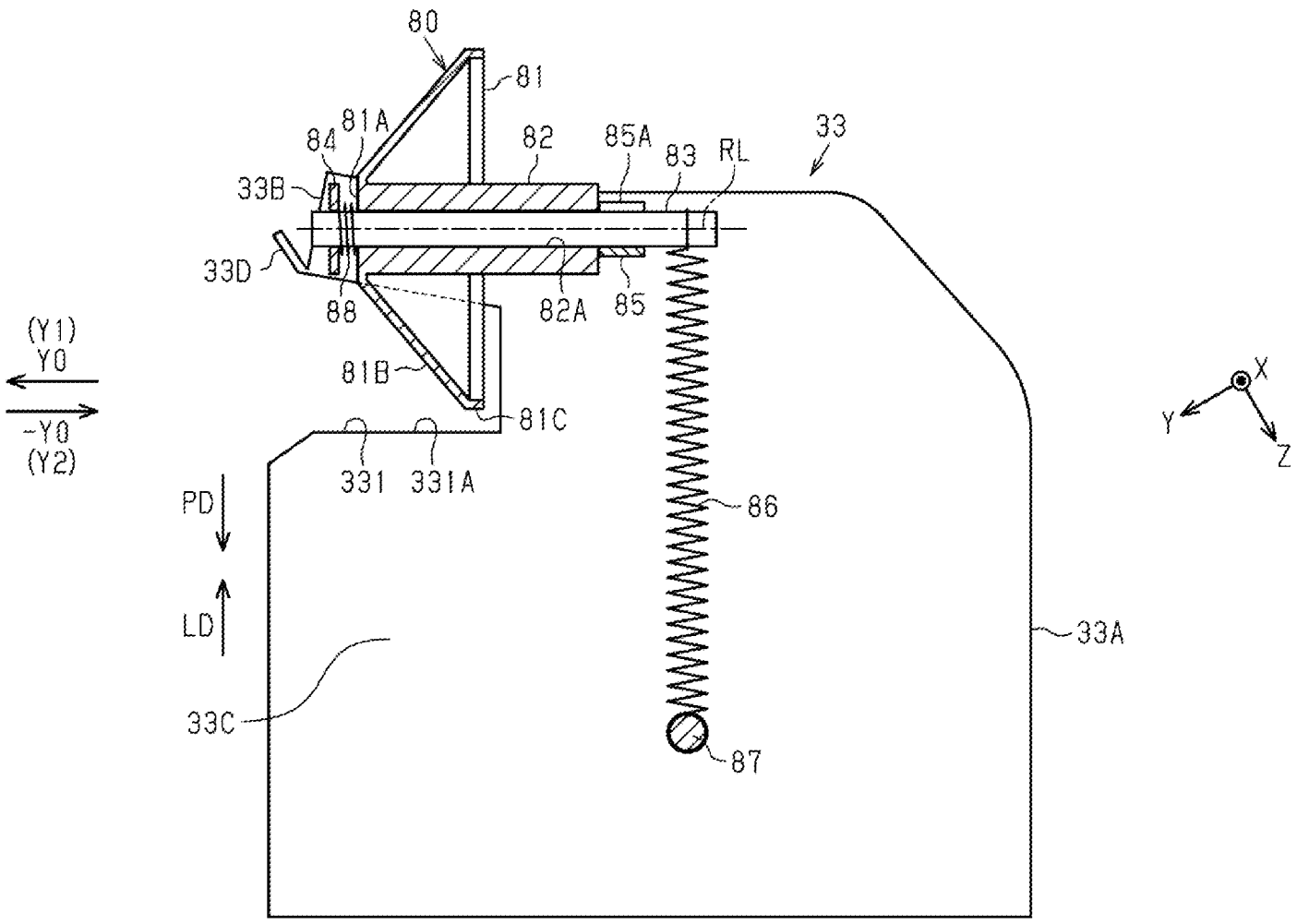
FIG. 5 is a side cross-sectional view illustrating the post-processing unit and the pressing mechanism.

Thus, if the media bundle 12B is simply aligned, the media bundle 12B swells in a loading direction (the thickness direction). In the present example, the pressing member 81 presses the swelling of the medium 12. It is sufficient that the pressing member 81 be capable of pressing the swelling of the media bundle 12B, and a pair of the pressing members 81 may be provided as illustrated in FIG. 4 and FIG. 5. In other words, the pressing members 81 may be provided on both sides in the movement direction (the width direction X) of the post-processing unit 33.

The main body 33A includes a recessed portion 331 that opens in an upper portion of a front surface, which is an upstream surface in the transport direction Y0. The recessed portion 331 is disposed at a height position corresponding to the rear end 12*r* of the medium 12 aligned by the rear end alignment units 47. The post-processing unit 33 performs the post-processing on a section of the rear end 12R of the media bundle 12B inserted into the recessed portion 331. Specifically, a staple driving portion 332 (see FIG. 14) that performs the stapling processing on the rear end 12R of the media bundle 12B is exposed on an upper wall surface of the recessed portion 331. As a result of the driving of the staple driving portion 332, the stapling processing is performed on a section, of the rear end 12R of the media bundle 12B aligned on the processing tray 32, that is positioned inside the recessed portion 331. Note that a supporting surface 47B, with which the rear end alignment unit 47 supports the back surface of the rear end of the medium 12, is positioned above a bottom surface 331A of the recessed portion 331 (see FIG. 10). Further, a guide unit 33D, which has an inclined shape and which guides the rear end 12*r* of the medium 12 into the recessed portion 331, extends above the opening of the recessed portion 331 in the main body 33A (see FIG. 4).

Further, a rail (not illustrated) that extends along the guide groove 55A is provided in the stage 55 illustrated in FIG. 4, and a guide portion that is guided by the rail is provided on the bottom of the main body 33A. Further, a belt type power transmission mechanism, which is an example of a power transmission mechanism, and which transmits the power of an electric motor (not illustrated), which is an example of a drive source, is provided in the stage 55. The belt type power transmission mechanism is provided with an endless timing belt extending along the guide groove 55A in the width direction X and having both ends wound around a pair of pulleys, and a section of the bottom portion of the main body 33A is fixed to a section of the timing belt. In this way, by the forward and reverse rotational driving of the electric motor, the timing belt rotates in the forward and reverse directions, and the post-processing unit 33 moves in the first direction X1 and the second direction X2 in a movement path along the guide groove 55A.

As illustrated in FIG. 4 and FIG. 5, the pressing members 81 are provided on both sides of the post-processing unit 33 in the width direction X. For example, the pressing members 81 may be disposed on either side of the opening of the recessed portion 331 in the width direction X.

The pressing member 81 is provided so as to be movable while rotating in conjunction with the movement of the post-processing unit 33, in a state of being in contact with the medium 12 that has been aligned by the rear end alignment units 47. It is sufficient that the pressing member 81 be provided so as to be movable in conjunction with the movement of the post-processing unit 33, and the pressing member 81 need not necessarily rotate in order to move in conjunction with the post-processing unit 33. In other words, the rotation of the pressing member 81 is not required.

In the example illustrated in FIG. 4 and FIG. 5, the pressing member 81 has a rotational axis RL in a direction orthogonal to the movement direction of the post-processing unit 33, and is provided so as to be rotatable in conjunction with the movement of the post-processing unit 33. The pressing member 81 of the present example is a rotating conical roller.

The pressing member 81 forms a conical shape and includes an top portion 81A facing upstream of the medium 12 in the transport direction Y0. The rotational axis RL passes through the top portion 81A. The pressing member 81 is configured to be rotatable about the rotational axis RL.

The pressing member 81 has a truncated cone-shaped conical surface 81B that increases in diameter from the top portion 81A to a bottom surface portion thereof, between the top portion 81A and the bottom surface portion having a maximum diameter. Further, the pressing member 81 includes a pressing surface 81C that is adjacent to the conical surface 81B and that is formed by an outer peripheral end face positioned on the large diameter side. The pressing surface 81C is an annular surface having a constant distance (radius) from the rotational axis line RL. Furthermore, the pressing member 81 includes a cylindrically shaped cylindrical portion 82 that extends along the rotational axis line RL.

As illustrated in FIG. 5, the pressing member 81 includes a through hole 82A that extends through the interior of the cylindrical portion 82 along the rotational axis line RL. The through hole 82A is a hole having a circular cross section. The pressing member 81 is rotatably supported about the rotational axis RL in a state in which a support shaft 83 is inserted through the through hole 82A. Specifically, the outer diameter of the support shaft 83 is slightly smaller than the inner diameter of the through hole 82A. The support shaft 83 is inserted into the through hole 82A.

As illustrated in FIG. 4, the main body 33A includes an upper extension portion 33B and a body lower portion 33C that face each other on either side of the recessed portion 331 in the up-down direction (the medium loading direction). A pair of plate-shaped first arm portions 84 extend outward in the width direction X from both sides of a tip portion of the upper extension portion 33B. The tip portion of the support shaft 83 is fixed to the tip portions of the pair of first arm portions 84.

A pair of second arm portions 85 extend outward in the width direction X from the upper side surfaces on both sides of the main body 33A. The second arm portion 85 includes a receiving portion 85A having a U-shaped cross section on the extended tip portion thereof. In other words, the receiving portion 85A has an opening that is open upward. The rear end of the support shaft 83 is supported by the second arm 85 in a state of being inserted into the receiving portion 85A. The width dimension of the receiving portion 85A is slightly larger than the outer diameter of the support shaft 83. Thus, the support shaft 83 can move in the loading direction along the inner wall surface of the receiving portion 85A.

As illustrated in FIG. 4 and FIG. 5, the pressing member 81 is urged toward the loading surface 32A of the processing tray 32. Specifically, the pressing member 81 is urged by a first elastic member 86 toward a pressing direction PD, which is a direction approaching the loading surface 32A of the processing tray 32. The first elastic member 86 is, for example, a tension spring. On one side surface of the main body 33A, a shaft 87 protrudes horizontally at a position below the rear end of the support shaft 83. One end of the first elastic member 86 is hooked on the rear end of the support shaft 83, and the other end thereof is hooked on the shaft 87. The rear end of the support shaft 83 is urged by the first elastic member 86 in the pressing direction PD, which is the downward direction, of two directions orthogonal to the loading surface 32A. Due to a gap (looseness) of an insertion location between the shaft 83 and the first arm portion 84, and a relative displacement in a loading direction LD between the rear end of the shaft 83 and the receiving portion 85A, the pressing member 81 can be displaced in the direction separating from the loading surface 32A. Note that the pressing direction PD and the loading direction LD are directions opposite to each other.

Further, as illustrated in FIG. 4 and FIG. 5, the pressing member 81 is urged upstream in the transport direction Y0. Specifically, the pressing member 81 is urged upstream in the transport direction Y0 by a second elastic member 88. The second elastic member 88 is, for example, a compression spring. The second elastic member 88 is interposed between the top portion 81A of the pressing member 81 having the truncated conical shape and the tip portion of the first arm 84 supporting the tip portion of the support shaft 83. The pressing member 81 is urged upstream in the transport direction Y0 by the second elastic member 88.

Figure 6:
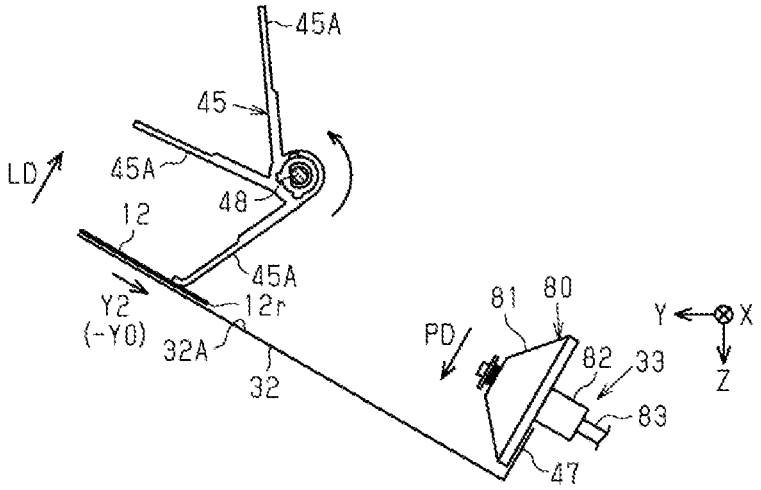
FIG. 6 is a schematic side view illustrating a medium alignment process.

As illustrated in FIG. 3 and FIG. 6, the medium 12 is stacked in the aligned state on the loading surface 32A of the processing tray 32. At this time, the pair of pressing members 81 of the post-processing unit 33 are disposed at positions within the width of the medium 12. As a result of the rotation of the first paddle 45, the medium 12 is drawn upstream in the transport direction Y0 along the loading surface 32A (see FIG. 6 and FIG. 7).

Figure 8:
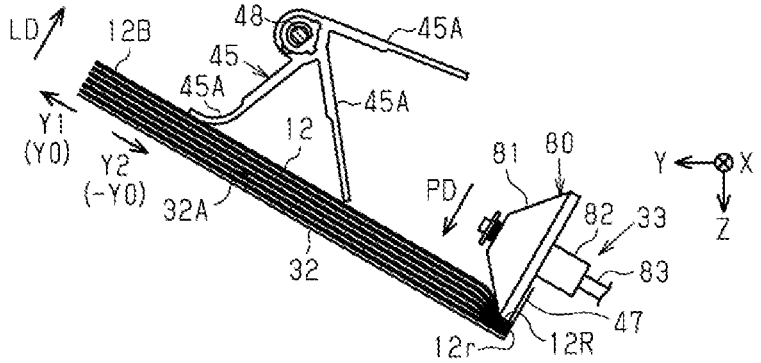
FIG. 8 is a schematic side view illustrating the medium alignment process.

As illustrated in FIG. 8, by causing the rear end 12*r* of the medium 12 drawn by the first paddle 45 to collide with the regulating surface 47A of the rear end alignment unit 47, the medium 12 is aligned in the transfer direction Y0. In the embodiment, the second paddle 46 also draws the medium 12 upstream in the transport direction Y0. Further, in the embodiment, as a result of the pair of alignment members 52 moving in the width direction X, the medium 12 on the processing tray 32 is aligned in the width direction X. This alignment in the width direction X may be performed during the alignment in the transport direction Y0, or may be performed after the alignment in the transport direction Y0 is complete.

The medium 12 discharged from the transport mechanism 30 downstream in the transport direction Y0 in this way is drawn upstream in the transport direction Y0 by the paddles 45 and 46, and is thus aligned in the two directions, namely, the transport direction Y0 and the width direction X, on the processing tray 32. Note that the medium 12 may be drawn upstream in the transport direction Y0 by a pulling member other than the paddles 45 and 46. Furthermore, a configuration may be adopted in which, due to the inclination of the processing tray 32, the medium 12 slides upstream in the transport direction Y0 under its own weight on the loading surface 32A or on the upper surface of the medium 12 that has already been aligned, and the pulling member may be omitted.

Each time the medium 12 is discharged from the transport mechanism 30, the medium 12 is drawn upstream in the transport direction Y0 by the paddles 45 and 46, thus forming the media bundle 12B in which the plurality of media 12 are stacked in the aligned manner on the processing tray 32.

Figure 9:
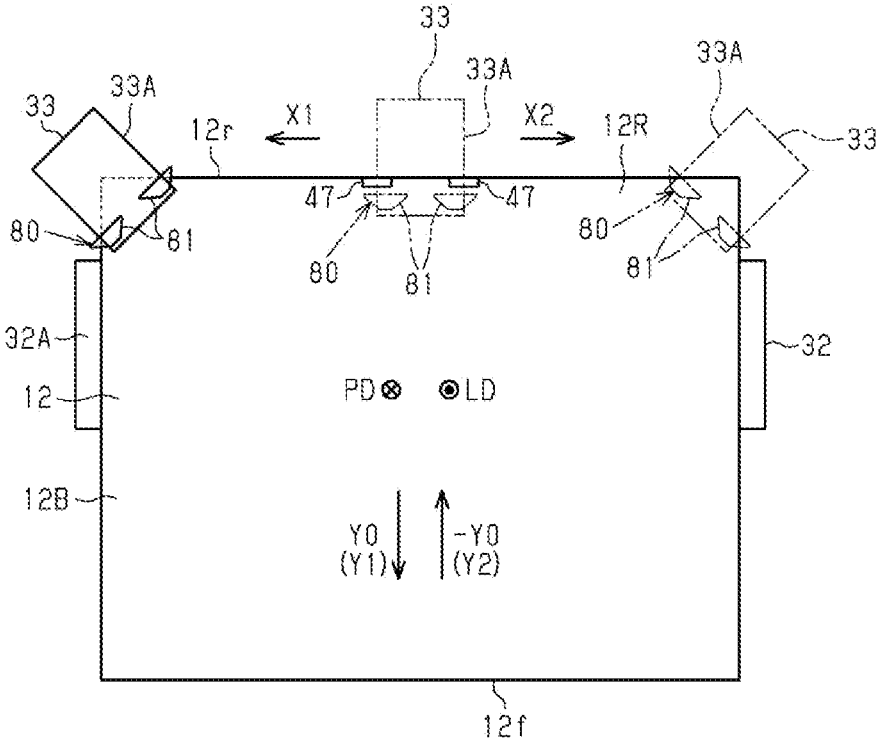
FIG. 9 is a schematic plan view describing a state in which the post-processing unit moves.

As illustrated in FIG. 9, the post-processing unit 33 may stand by at a central width position of the medium 12 during the alignment process. This is because, when there is deviation of the medium 12 in the width direction X due to frictional resistance received by contact with the pressing members 81, the medium 12 is more likely be skewed in the alignment process. Note that, when the medium 12 does not receive as much frictional resistance as to become skewed, a standby position of the post-processing unit 33 may be a position offset from the center position in the width of the medium 12 in the width direction X.

As illustrated in FIG. 9, for example, the post-processing unit 33 moves from the standby position in the first direction X1 or the second direction X2 and performs the parallel stapling at two locations. Alternatively, the post-processing unit 33 moves from the standby position in the first direction X1 to one corner of the media bundle 12B, and is disposed in an inclined posture at the corner (a position indicated by solid lines in FIG. 9). Then, the post-processing unit 33 performs the oblique stapling on the one corner of the media bundle 12B. Further, the post-processing unit 33 moves in the second direction X2 to another corner of the media bundle 12B, and is disposed in an inclined posture at the corner (a position indicated by a two-dot chain line on the right side in FIG. 9). Then, the post-processing unit 33 performs the oblique striking on the other corner of the media bundle 12B.

As illustrated in FIG. 9, at whichever position on the rear end 12R the post-processing unit 33 performs the post-processing, during that post-processing, the pair of pressing members 81 are in positions in contact with the media bundle 12B. Thus, the post-processing unit 33 performs the post-processing at a position between two locations at which the rear end 12R is pressed by the pair of pressing members 81.

Figure 10:
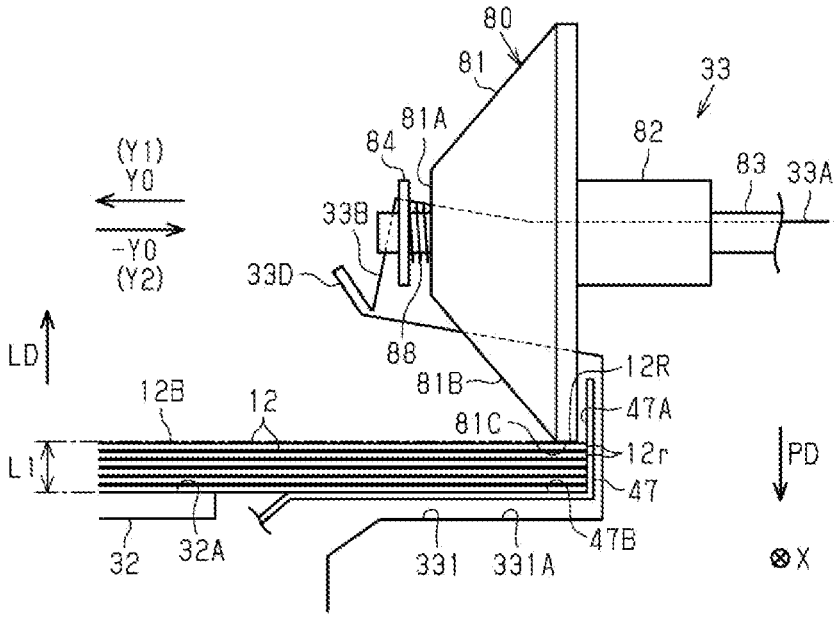
FIG. 10 is a schematic side view illustrating a state in which a predetermined number of the media are stacked.

As illustrated in FIG. 10, when the pressing member 81 is in a lowermost position illustrated in FIG. 10, in which the pressing member 81 is positioned closest to the loading surface 32A due to the urging force of the first elastic member 86, a space between the supporting surface 47B of the rear end alignment unit 47 and the lower end of the pressing member 81 is a distance L1. Here, the distance L1 is set to a distance that allows the maximum number of media 12 to be stacked when an estimated maximum load number of the media 12 are loaded. The maximum load number is, for example, a predetermined number between 10 to 100 sheets (50, for example).

As illustrated in FIG. 10, the medium 12 to which the liquid, such as the ink or the like, is attached by the recording unit 24 is likely to curl, and thus, when the predetermined number of media 12 are stacked, the media 12 swell in the loading direction LD. Thus, when the estimated maximum load number of the media 12 are loaded on the processing tray 32, a loaded thickness thereof is greater than the predetermined distance L1. For example, a necessity arises to set a staple width corresponding to a total thickness of the media 12 to a number (55, for example) that is larger than the estimated maximum load number (50, for example) of the media 12. Here, the staple width refers to an opening height dimension required to insert the media 12 into the opening of the recessed portion 331. Since the media bundle 12B swells in the thickness direction and the total thickness thereof increases due to the curl of the media 12, it is necessary to set the staple width to be wide. When the staple width is set to be wider than a value corresponding to the estimated maximum load number, this means that the post-processing is performed on the media bundle 12B in the swollen state, and thus, the possibility increases that this will lead to post-processing errors. When the post-processing is the stapling processing, a stapling error easily occurs, such as not being able to push the staple pin through the media bundle 12B, or not being able to properly bend the staple pin even if the pin is pushed through. Further, when the post-processing is the punching processing, a punching position shift error easily occurs in which positions of holes become displaced between the media 12 configuring the media bundle 12B. Furthermore, when the post-processing is the folding processing, a folding position shift error easily occurs, in which positions for forming the folds become displaced between the media 12 configuring the media bundle 12B.

Thus, in the embodiment, by pressing the rear end 12R of the media bundle 12B that has swollen in the loading direction LD using the pressing members 81, the opening height dimension (the staple width) for inserting the rear end 12R into the recessed portion 331 is caused to be as close as possible to the predetermined distance L1. Note that in the embodiment, the opening height dimension is a height dimension between the supporting surface 47B, which is the surface on which the medium is supported on the rear end alignment unit 47, and the pressing member 81.

Next, an electrical configuration of the recording system 11 will be described. The recording device 13 receives recording data from a host device (not illustrated), for example. The recording data includes recording condition information, and image data of a CMYK color system, for example, that defines recording content. The recording condition information includes information relating to the medium size, the medium type, the presence or absence of the double-sided recording, a recording color, a recording quality, a total recording number, and post-processing condition information. The post-processing condition information includes information such as the type of the post-processing, the post-processing position, and the number (the target number) of media for each time the post-processing is performed. The control unit (not illustrated) in the recording device 13 controls the liquid discharge head 25, the transport unit 100, and the intermediate device 15. In this way, the control unit of the recording device 13 controls the operations of the liquid discharge head 25, the transport unit 100, and the intermediate device 15.

Further, the control unit 110 illustrated in FIG. 1 controls the post-processing device 14. The control unit 110 counts the number of media 12 loaded on the processing tray 32 using a counter (not illustrated). The control unit 110 is electrically coupled to the transport mechanism 30, the receiving mechanism 41, the feeding mechanism 43, the alignment mechanism 51, the post-processing unit 33, the discharge mechanism 36, the pushing-down mechanism 70, the guide mechanism 75, and the supporting mechanism 79. The control unit 110 controls the operations of each of the mechanisms and units 30, 33, 36, 41, 43, 51, 70, 75, and 79. The control unit 110 executes post-processing control on the basis of the post-processing condition information indicated by a job received from the recording device 13.

The control unit 110 detects the rear end 12*r* of the medium 12 as a result of switching from a detection state in which the sensor 34 detects the medium 12 to a non-detection state in which the medium 12 is not detected. When the medium loading number on the processing tray 32 reaches the target number, the control unit 110 performs the post-processing indicated by the job, on the media bundle 12B loaded on the processing tray 32. In the present example, the control unit 110 drives and controls the electric motor, which is the drive source for moving the post-processing unit 33, to move the post-processing unit 33 to the target position, which is the post-processing position. Then, the control unit 110 performs the stapling processing as an example of the post-processing. In other words, the control unit 110 drives the staple driving portion 332 to cause the post-processing unit 33 to perform the stapling operation.

Next, effects of the recording system 11 will be described.

The recording condition information and the post-processing condition information are input and set by the user operating a pointing device, such as a keyboard, a mouse, or the like (both not illustrated) of a host device (not illustrated). The recording condition information includes the medium size, the medium type, the recording color, the total recording number, and the like. Further, the post-processing condition information includes the presence or absence of the post-processing, the post-processing content, and the number of the media 12 configuring the one media bundle 12B. For example, an example of processing having no post-processing includes "free stacking", and examples of the post-processing include the "stapling processing", the "punching processing", the "center binding processing", the "folding processing", and the like. A set number of sheets is the "number of stacked sheets" of the media bundle 12B to be processed. For example, this indicates the number of sheets in the media bundle 12B stapled by the stapling processing, and the number of sheets in which the holes are formed in the media bundle 12B in the punching processing. The post-processing may also be "crimping" which is pin-free stapling.

The recording device 13 receives the recording data from the host device. The recording device 13 acquires, from the post-processing condition information included in the recording data, information such as the type of the post-processing, the post-processing position, the set number of sheets, and the like.

The control unit of the recording device 13 determines, from the post-processing information, the presence or absence of the post-processing, and transmits the job including the content of the post-processing to the control unit 110 when the post-processing type is indicated. When the control unit 110 receives the job, by controlling the transport mechanism 30, the receiving mechanism 41, the feeding mechanism 43, and the alignment mechanism 51, the control unit 110 performs media bundle formation control in which the media 12 are stacked one at a time on the processing tray 32 to form the media bundle 12B with the target number of the media 12 on the processing tray 32. As a result of the media bundle formation control, the control unit 110 performs post-processing control when the media bundle 12B with the target number of media 12 is formed on the processing tray 32.

As illustrated in FIG. 3 and FIG. 6, the media 12 are stacked in the aligned state on the loading surface 32A of the processing tray 32. At this time, the post-processing unit 33 is disposed in the standby position, which is the position where the pair of pressing members 81 overlap with the medium 12. When the first paddle 45 rotates, the medium 12 is drawn on the loading surface 32A upstream in the transport direction Y0.

Figure 7:
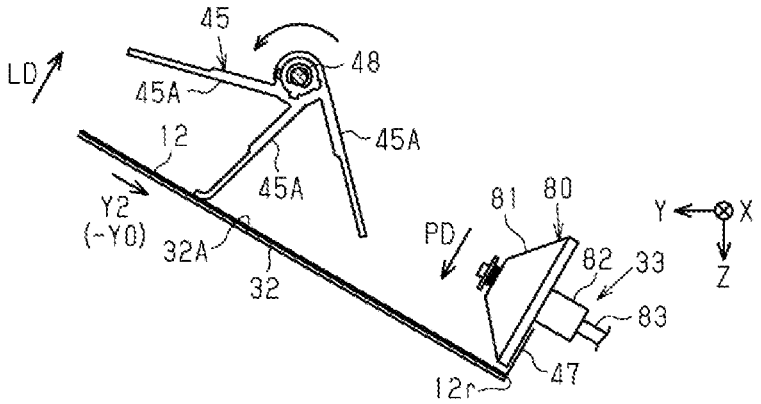
FIG. 7 is a schematic side view illustrating the medium alignment process.

As illustrated in FIG. 7, the medium 12 drawn by the first paddle 45 is aligned in the transport direction Y0 by the rear end 12*r* colliding with the regulating surface 47A of the rear end alignment unit 47. In the embodiment, the second paddle 46 also draws the medium 12 upstream in the transport direction Y0. Further, in the embodiment, the pair of alignment members 52 move in the width direction X to align the medium 12 on the processing tray 32 in the width direction X. This alignment in the width direction X may be performed during the alignment in the transport direction Y0, or may be performed after the alignment in the transport direction Y0 has been performed.

The medium 12 discharged from the transport mechanism 30 downstream in the transport direction Y0 in this manner is tapped downward by the variable guide 42 that has been rotationally displaced, and is guided onto the processing tray 32. As a result of the first paddle 45 beginning to rotate during this guiding, the first paddle 45 also guides the medium 12 onto the processing tray 32. The medium 12 guided onto the processing tray 32 is drawn upstream in the transport direction Y0 by the rotating paddles 45 and 46. The medium 12 is aligned in the transport direction Y0 as a result of the rear end 12*r* colliding with the regulating surface 47A of the rear end alignment unit 47. Further, the alignment mechanism 51 is driven and the pair of alignment members 52 tap the side edges on both sides of the medium 12 so that the medium 12 is also aligned in the width direction X. The medium 12 is aligned in the two directions on the processing tray 32, that is, in the transport direction Y0 and the width direction X. Each time the medium 12 is discharged from the transport mechanism 30, the medium 12 is drawn upstream in the transport direction Y0 by the paddles 45 and 46, thus forming the media bundle 12B in which the plurality of media 12 are stacked in the aligned state on the processing tray 32.

Note that the medium 12 may be drawn upstream in the transport direction Y0 by a pulling member other than the paddles 45 and 46. The pulling member may be a driving roller capable of coming into contact with and separating from the medium 12. Furthermore, when, due to the inclination of the processing tray 32, the medium 12 slides upstream in the transport direction Y0 under its own weight on the loading surface 32 or on the upper surface of the medium 12 that has already been aligned, the pulling member may be omitted.

As illustrated in FIG. 9, in the alignment process, the post-processing unit 33 stands by at the central width position of the medium 12, for example. Thus, there is no deviation in the width direction X of the medium 12 due to the frictional resistance received by contact with the pressing member 81, and the medium 12 is less likely to be skewed in the alignment process.

As illustrated in FIG. 9, for example, the post-processing unit 33 performs the post-processing on the position based on the post-processing condition information. For example, when the parallel stapling at the two locations is specified, the post-processing unit 33 moves in the first direction X1 or the second direction X2 from the standby position, and performs the flat stamping at the two locations. In addition, when the oblique stapling is specified, the post-processing unit 33 moves in the first direction X1 from the standby position to one corner of the media bundle 12B, and is disposed in the inclined posture at the corner (the position indicated by the solid lines in FIG. 9). Then, the post-processing unit 33 performs the oblique stapling on the one corner of the media bundle 12B.

Alternatively, the post-processing unit 33 moves in the second direction X2 from the standby position to the other corner portion of the media bundle 12B, and is disposed in the inclined posture at the corner (the position indicated by the two-dot chain lines on the right side in FIG. 9). Then, the post-processing unit 33 performs the oblique stapling on the other corner of the media bundle 12B.

As illustrated in FIG. 9, at whichever position on the rear end 12R the post-processing unit 33 performs the post-processing, during that post-processing, the pair of pressing members 81 are in the positions of being able to be in contact with the media bundle 12B. Thus, the post-processing unit 33 performs the post-processing at the position between the two locations at which the rear end 12R is pressed by the pair of pressing members 81.

Figure 11:
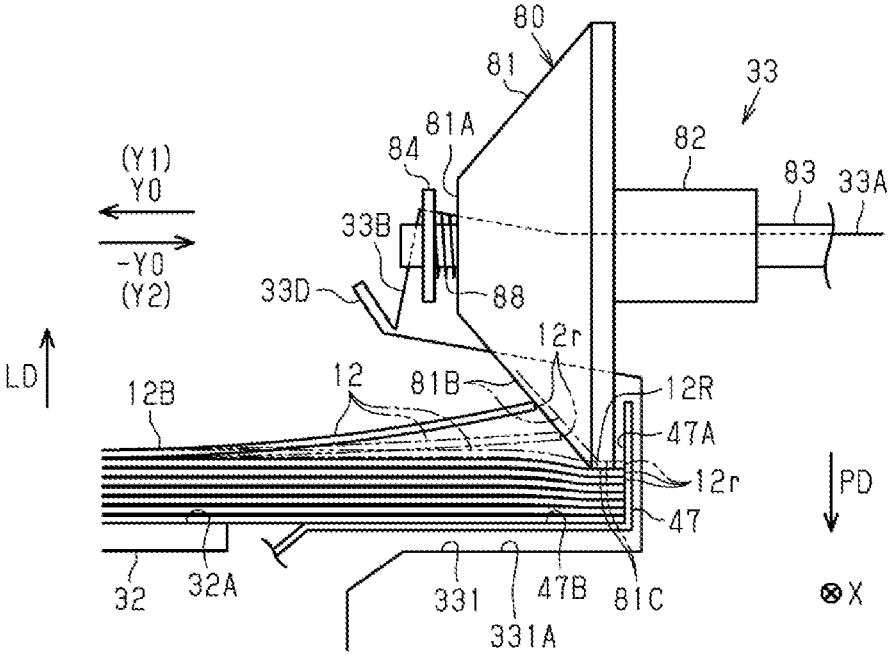
FIG. 11 is a schematic side view illustrating a state in which the media are further stacked, after the predetermined number of the media are stacked.

Further, as illustrated in FIG. 11, the pressing member 81 has the truncated cone shape, and is disposed such that the top portion 81A is in the posture facing downstream in the transport direction Y0. In a side view in FIG. 11, the lower end of the conical surface 81B is positioned downstream, in the transport direction Y0, of the regulating surface 47A of the rear end alignment unit 47, and above the supporting surface 47B. This conical surface 81B functions as an inclined guide surface that is positioned lower the further downstream in the transport direction Y0. Thus, as illustrated in FIG. 11, even if the rear end 12*r* of the medium 12 being fed downstream in the transport direction Y0 lifts up, the rear end 12*r* is guided along the conical surface 81B in a direction approaching the supporting surface 47B. Then, before colliding with the regulating surface 47A, the rear end 12*r* is pushed between the bundle of the previously loaded media 12 and the pressing surface 81C of the pressing member 81. Thus, the rear end 12R of the new media bundle 12B, which is formed by the uppermost medium 12 fed upstream in the transport direction Y0 by the paddles 45 and 46 and a bundle of the media 12 that have been previously loaded, is pressed by the pressing member 81.

At this time, when the loaded thickness of the rear end 12R of the media bundle 12B exceeds the distance L1 (see FIG. 10), the pressing member 81 receives an upward force from the medium 12 when the rear end 12*r* of the medium 12 is fed below the pressing surface 81C. Due to this upward force, the rear end of the support shaft 83 lifts in the loading direction LD against the urging force of the first elastic member 86 (see FIG. 5), and the lower surface of the pressing member 81 tilts as indicated by the two-dot chain line in FIG. 11. As a result of the tilting of the pressing member 81, the pressing surface 81C is displaced in a direction (diagonally upward) separating from the supporting surface 47B.

In this way, after the loaded thickness of the media 12 swollen with the ink exceeds the predetermined distance L1, the rear end 12R is compressed by the pressing member 81 to a stacked thickness corresponding to the distance L1. Then, subsequently, when the next medium 12 is fed in, the uppermost medium 12 can enter below the pressing surface 81C as a result of the pressing member 81 rising up or tilting against the urging force of the first elastic member 86. Then, the rear end 12R of the media bundle 12B is compressed by the pressing member 81 to the stacked thickness corresponding to the distance L1. Even if the stacking of the target number of media 12 has finished, the rear end 12R of the media bundle 12B is compressed to the distance L1 by the pressing member 81.

Figure 12:
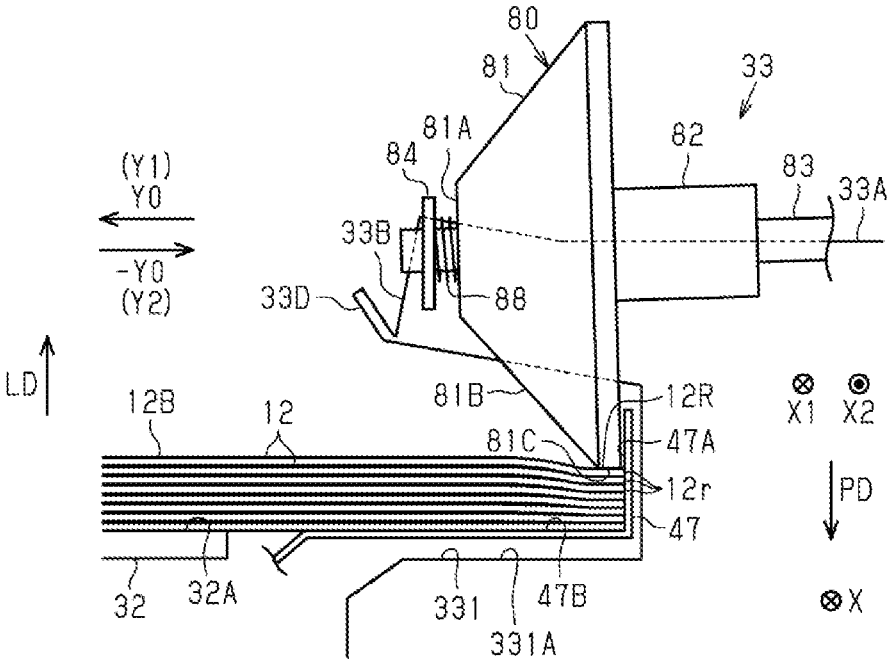
FIG. 12 is a schematic side view illustrating a state in which a target number of the media are stacked.

In this way, as illustrated in FIG. 12, when the media bundle 12B loaded on the processing tray 32 has reached the target number of sheets, the rear end 12R of the media bundle 12B is compressed by the pressing member 81 with a pressing force based on the urging force of the first elastic member 86.

For example, when the media bundle 12B having the maximum load number is loaded, at the same time as the recorded media 12 becoming thicker than the original thickness due to absorbing the ink and becoming swollen, small wrinkles (cockling) caused by that swelling also occur. Furthermore, the media 12 that has absorbed the ink and become swollen is often curled. Then, even when the media 12 having the cockling and the curl are stacked up to the maximum load number, the rear end 12R of the media bundle 12B is compressed to a stacked thickness substantially corresponding to the distance L1.

For example, when the stacked thickness is greater than the distance L1 even when compressed by the pressing member 81 when stacked at the maximum load number, as a result of the pressing member 81 being displaced in the loading direction LD, although the stacked thickness of the rear end 12R slightly exceeds the distance L1, the rear end 12R is compressed by the pressing member 81.

Figure 13:
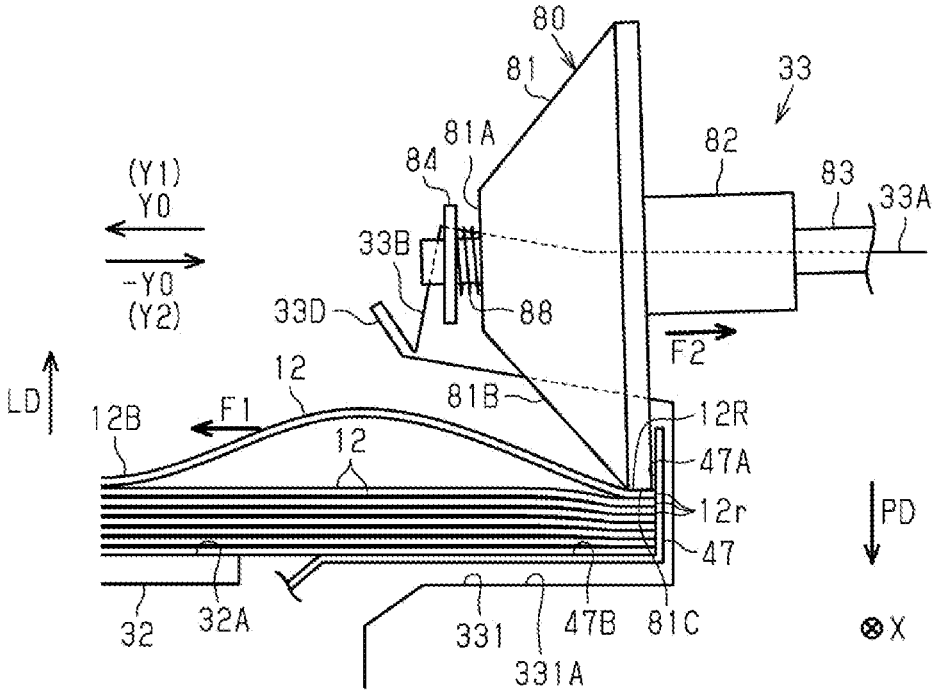
FIG. 13 is a schematic side view illustrating an effect after the media come into contact with a rear end alignment portion when the predetermined number or more of the media are stacked.

Incidentally, when the rear end 12*r* of the medium 12 collides with the regulating surface 47A of the rear end alignment unit 47, the medium 12 receives a force from the regulating surface 47A acting downstream in the transport direction Y0. As a result, as illustrated in FIG. 13, when the rear end 12*r* of the medium 12 collides with the regulating surface 47A, the rear end 12*r* may bend as a result of a reaction to the collision. When the bending of the medium 12 is released, a force F1 is generated in the medium 12 acting downstream in the transport direction Y0. This force F1 causes the medium 12 to shift, from the alignment position, downstream in the transport direction Y0. In the embodiment, the pressing member 81 is urged in a direction upstream in the transport direction Y0 by the urging force of the second elastic member 88. Thus, when the uppermost medium 12 in contact with the pressing member 81 attempts to shift downstream in the transport direction Y0 as a result of the force F1, a force F2 caused by the urging force of the second elastic member 88 acts on the uppermost medium 12 in a direction to obstruct that shift. As a result, a position shift of the medium 12 downstream in the transport direction Y0 is suppressed due to a reaction force generated when the rear end 12*r* collides with the regulating surface 47A. Thus, the medium 12 is aligned in the transport direction Y0 with almost no deviation. As a result, the post-processing can be performed on the media bundle 12B aligned with a high degree of alignment in the transport direction Y0.

Figure 14:
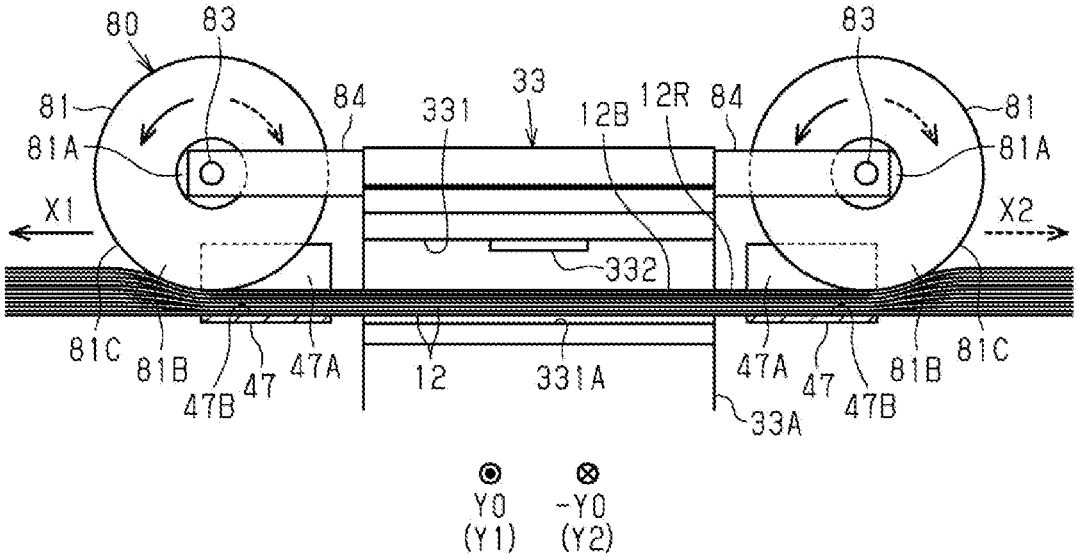
FIG. 14 is a schematic front view illustrating a state in which the pressing member rolls when the post-processing unit moves.

As illustrated in FIG. 14, when the alignment processing of the media bundle 12B ends, the post-processing unit 33 transfers to the post-processing process in which the post-processing unit 33 performs the post-processing. The rear end 12R of the media bundle 12B is compressed at a section pressed by the pressing member 81, and in the vicinity of that section. In particular, swelling of a section of the rear end 12R that is sandwiched by the pair of pressing members 81 is suppressed. The staple driving portion 332 is positioned while being sandwiched between the pair of pressing members 81 in the width direction X. The staple driving portion 332 performs the stapling processing on the rear end 12R at a location at which the swelling is suppressed by the pair of pressing members 81. Thus, the frequency of errors in the post-processing, such as the stapling processing, is reduced.

The post-processing unit 33 may be configured to perform the post-processing at the standby position, but normally, after the completion of the alignment process and before performing the post-processing, the post-processing unit 33 moves in the width direction X to the target position. For example, the post-processing unit 33 may move from the standby position to the target post-processing position to perform the post-processing, or the post-processing may be performed in which, after finishing first post-processing, the post-processing device 33 moves to a second post-processing position.

In these cases, in accordance with the post-processing unit 33 moving in the width direction X, the pressing member 81 rotates (rolls) in the state of being in contact with the medium 12, and moves while pressing the media bundle 12B. Specifically, as illustrated in FIG. 14, when the post-processing unit 33 moves in the first direction X1, the pressing members 81 rotate in the counterclockwise direction indicated by the solid arrows in FIG. 14 in the state of being in contact with the medium 12, and the pair of pressing members 81 move while pressing the rear end 12R. Further, when the post-processing unit 33 moves in the second direction X2, the pressing members 81 rotate in the clockwise direction indicated by the dashed arrows in FIG. 14 in the state of being in contact with the medium 12, and the pair of pressing members 81 move while pressing the rear end 12R.

Thus, when the post-processing unit 33 reaches the target post-processing position, as illustrated in FIG. 14, the swelling of the rear end 12R is suppressed at a position sandwiched between the pair of pressing members 81 in the width direction X. The staple driving portion 332 performs the stapling processing on the location, on the media bundle 12B, at which the swelling is suppressed. As a result, the frequency of errors in the post-processing, such as the stapling processing, is reduced.

After the post-processing is complete, the control unit 110 performs the following discharge operation. The pressing member 71 stands by at a guide position illustrated in FIG. 2. Further, the pair of medium supporting members 38 stand by at a support position indicated by solid lines in FIG. 3. The control unit 110 performs the discharge operation of the media bundle 12B.

When the post-processing is complete, the control unit 110 moves the driven roller 36B from the separated position illustrated in FIG. 2 to the nip position, thus nipping the media bundle 12B using the pair of rollers 36A and 36B. Next, the control unit 110 drives the driving roller 36A to discharge the media bundle 12B placed on the processing tray 32. The media bundle 12B is discharged from the processing tray 32 toward the first transport direction Y1 (downstream in the transport direction Y0). The media bundle 12B is discharged while being guided from above by the pressing member 71 and the guide member 37. The tip portion of the media bundle 12B that has curled is suppressed from being displaced excessively upward.

In this discharge process, the pressing member 71, which has been lowered from the standby position to a pressing position, pushes the rear end of the media bundle 12B downward. As a result, a discharge error is prevented in which the rear end of the media bundle 12B becomes caught on the driving roller 36A or a peripheral section thereof and does not fall.

The pair of medium supporting members 38 are separated from the support position indicated by the solid lines in FIG. 3 to the retracted position indicated by the two-dot chain lines in FIG. 3. As a result, the media bundle 12B falls onto the discharge tray 35. The media bundle 12B initially discharged onto the pair of medium supporting members 38 falls from the pair of medium supporting members 38 to the discharge tray 35. As a result, folding of the tip portion of the media bundle 12B, which occurs when the media bundle 12B is discharged onto the discharge tray 35 in a state in which the tip portion is hanging down, is suppressed.

As described above, according to the embodiment, the following effects can be achieved.

(1) The post-processing device 14 includes the processing tray 32 onto which the medium 12 on which recording was performed by the recording unit 24 is loaded, the rear end alignment unit 47 that aligns the rear end 12*r* (an example of an end portion) of the medium 12 in the processing tray 32, the post-processing unit 33 that performs the post-processing on the medium 12 aligned by the rear end alignment unit 47, and the pressing member 81 that presses the rear end 12*r* of the medium 12. The pressing member 81 is configured to move in conjunction with the movement of the post-processing unit 33 in a state in which the pressing member 81 is in contact with the medium 12 aligned by the rear end alignment unit 47. Thus, when the post-processing unit 33 moves, the pressing member 81 thinly stretches out the swelling of the medium 12 by coming into contact with the medium 12, and the post-processing is performed at a location at which the swelling of the medium 12 is suppressed. In this way, the quality of the post-processing on the medium 12 that has curled can also be improved. Thus, the post-processing can be performed on the medium 12 in a state in which the swelling of the medium 12 has been stretched out, and the quality of the post-processing is improved.

(2) The pressing member 81 includes the rotational axis RL extending in a direction orthogonal to the movement direction of the post-processing unit 33, and is provided so as to be rotatable in conjunction with the movement of the post-processing unit 33. Thus, since the pressing member 81 is in contact with the medium 12 while rotating when the post-processing unit 33 moves, it is possible to prevent scratches when thinly stretching out the swelling of the medium 12.

(3) The pressing member 81 forms the conical shape, and includes the top portion 81A facing upstream in the transport direction Y0 of the medium 12. The pressing member 81 is configured to be rotatable about the rotational axis RL, which passes through the top portion 81A. Thus, the rear end 12*r* of the medium 12 abuts the conical surface of the pressing member 81 having the conical shape, and the rear end is guided along the conical surface toward the outer peripheral end surface that has the maximum diameter of the pressing member 81. As a result, the rear end 12*r* of the medium 12 is pressed by the outer peripheral end portion of the pressing member 81. Thus, when aligning the medium 12, the medium 12 can be moved without resistance to a location to be pressed by the pressing member, and further, when the post-processing unit 33 moves, the pressing member 81 can rotate and thinly stretch out the swelling of the medium 12. As a result, the location of the post-processing of the medium 12 can be reliably pressed. Thus, the post-processing can be performed on the location, of the medium 12, that has been thinly stretched out.

(4) The pressing member 81 is provided on both sides in the movement direction (the width direction X) of the post-processing unit 33. Thus, whichever direction the post-processing unit 33 moves in in the width direction X, the pressing member 81 presses an advance position in that movement direction while rotating, and it is thus possible to reliably thinly stretch out the swelling of the medium 12 at the location at which the post-processing is performed.

(5) The pressing member 81 is urged toward the loading surface 32A of the processing tray 32. Thus, the swelling of the media bundle 12B can be thinly stretched out, and the aligned media bundle 12B can be held without any position shift.

(6) The pressing member 81 is urged upstream in the transport direction Y0. Thus, even if the aligned medium 12 attempts to move downstream in the transport direction Y0 due to a reaction force, the medium 12 is subject to a force from the pressing member 81 in a direction opposite to that movement direction, and it is thus possible to suppress a position shift of the medium 12 from the aligned position.

(7) The pressing member 81 is configured to be able to separate from the medium 12 and is separated from the medium 12 when the medium 12 is being aligned by the rear end matching unit 47. The pressing member 81 is in contact with the medium 12 when the post-processing unit 33 moves and when the post-processing is performed on the medium 12. Thus, by separating the pressing member from the medium when the medium 12 is being aligned, the medium 12 can be aligned by the rear end alignment unit 47 without resistance, and further, the post-processing can be performed at the location at which the swelling of the media bundle 12B is thinly stretched out.

(8) The pressing member 81 includes the conical surface 81B, which is an example of a guide surface for guiding the rear end 12*r* of the medium 12 so as to be inserted below the pressing member 81. Thus, even if the loaded thickness of the media bundle 12B is swollen due to the curl of the medium 12, the rear end 12*r* of the medium 12 can be inserted below the pressing member 81.

(9) The medium 12 is inserted below the pressing member 81 while displacing the pressing member 81 in the loading direction LD against the urging force of the first elastic member 86. Thus, even if the media bundle 12B is swollen and the loaded thickness increases due to the curl of the medium 12, the rear end 12*r* of the medium 12 can be inserted below the pressing member 81.

(10) A dimension of the opening into which the medium 12 is inserted, which is the dimension between the supporting surface 47B and the pressing member 81, is set to the predetermined distance L1, which is smaller than the loaded thickness of the media bundle 12B swollen due to the curl of the medium 12. Thus, even when the media bundle 12B is swollen due to the curl of the medium 12, the post-processing can be performed on the rear end 12R of the media bundle 12B in a state in which the stacked thickness of the rear end 12R is compressed to the predetermined distance L1. For example, when the predetermined distance L1 is set to be the stacked thickness corresponding to the maximum load number using the number of media 12 before recording, the post-processing can be performed on the media bundle 12B in a state in which the rear end 12R of the media bundle 12B of the maximum load number that is swollen due to the curl is compressed to the stacked thickness substantially corresponding to the predetermined distance L1.

Second Embodiment

Next, a second embodiment will be described with reference to FIG. 15 to FIG. 17. In the second embodiment, a configuration of the pressing member 81 differs from that of the first embodiment. The post-processing device 14 according to the second embodiment is provided with the processing tray 32, the paddles 45 and 46, and the rear end alignment unit 47, in a similar manner to the first embodiment. Further, a configuration that is the same as that of the first embodiment will be assigned the same reference sign and an explanation thereof will be omitted.

Figure 15:
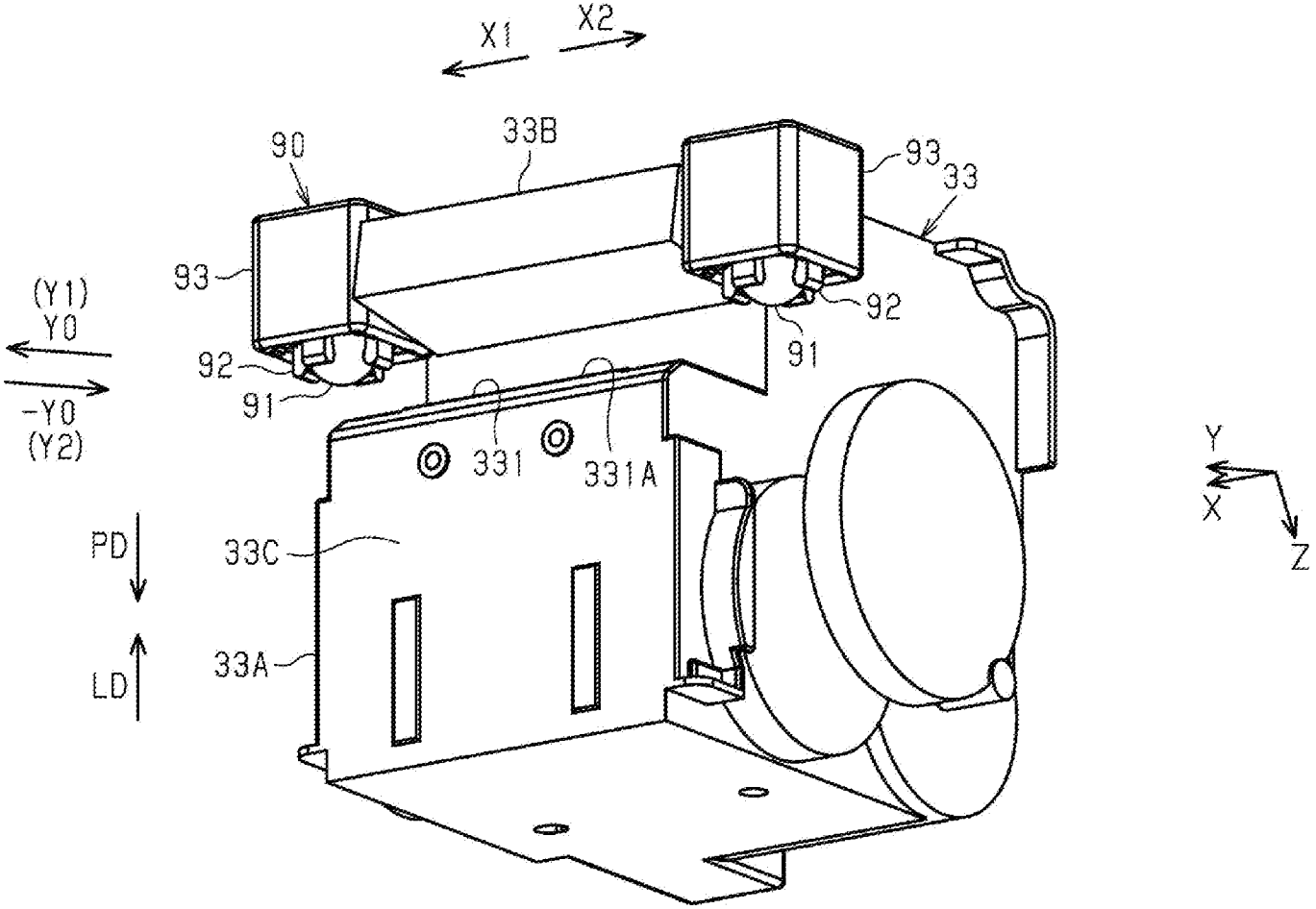
FIG. 15 is a perspective view illustrating the post-processing unit and a pressing mechanism according to a second embodiment.
Figure 16:
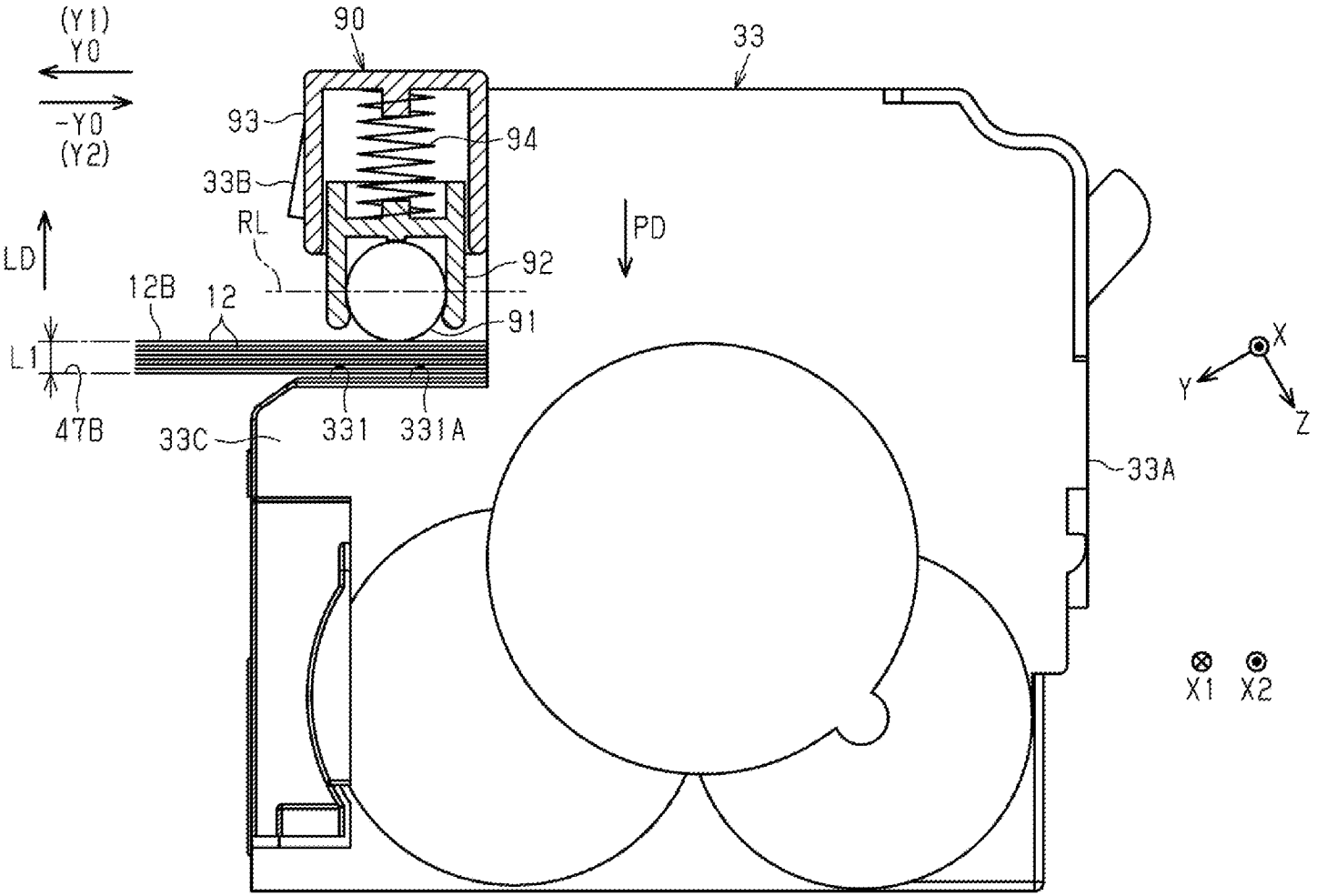
FIG. 16 is a side view illustrating the post-processing unit and the pressing mechanism.

As illustrated in FIG. 15 and FIG. 16, the post-processing unit 33 includes the main body 33A including the recessed portion 331, and a pressing member 91 that presses the rear end 12R of the media bundle 12B aligned by the rear end alignment unit 47 in the processing tray 32. The pressing member 91 is provided so as to be movable in conjunction with the movement of the post-processing unit 33 in a state of being in contact with the medium 12 aligned by the rear end alignment unit 47. The pressing member 91 of the present example is spherical. In other words, the pressing member 91 is a ball. Thus, the pressing member 91 is provided so as to be able to rotate in conjunction with the movement of the medium 12 in the transport direction Y0 and the movement of the post-processing unit 33 in the movement direction (the width direction X).

The pressing member 91 may be provided on both sides of the post-processing unit 33 in the width direction X. For example, a pair of the pressing members 91 may be provided on both sides of the post-processing unit 33 sandwiching the recessed portion 331 in the width direction X. A pressing mechanism 90 includes the pressing members 91, bearings 92 that hold the pressing members 91 in a freely rotatable state, and square box-shaped housings 93 that hold the bearings 92 in a lower portion thereof. The housing 93 is the square box shape and is open downward. The bearing 92 is assembled in the lower portion of the housing 93 such that the bearing 92 can be displaced in the pressing direction PD.

Note that in FIG. 15, the shape of the main body 33A differs partially from that of the first embodiment, but the basic configuration and functions thereof are the same. In other words, the main body 33A is fixed to a part of a timing belt configuring a power transmission mechanism provided in the stage 55 (both not illustrated), while a guide member (not illustrated) that is guided along a rail (not illustrated) provided in the stage 55 is also fixed to a bottom portion of the main body 33A. Thus, as a result of the forward and reverse rotational driving of an electric motor as a drive source (not illustrated), the post-processing unit 33 moves in the first direction X1 and the second direction X2 along the guide groove 55A. Then, the post-processing unit 33 is inclined to the 45 degree posture, for example, at both ends of a movement path along the guide groove 55A (see FIG. 3). Thus, when the post-processing unit 33 performs the stapling processing as the post-processing, it is possible to perform the parallel stapling and the oblique stapling. Further, in a similar manner to the first embodiment, a part of the staple driving portion 332 is exposed in the upper wall surface of the recessed portion 331, and, by driving the staple driving portion 332, the stapling processing is performed on a portion, of the rear end 12R of the media bundle 12B, positioned inside the recessed portion 331.

As illustrated in FIG. 16, since the pressing member 91 is the freely rotatable ball, the pressing member 91 includes a rotational axis RL in a direction (the transport direction Y0) orthogonal to the movement direction of the post-processing unit 33 (the width direction X). Note that the rotational axis RL is one rotational axis of a plurality of rotational axes of the freely rotatable pressing member 91. As described above, the pressing member 91 may include the plurality of rotational axes including the rotational axis RL in the direction (the transport direction Y0) orthogonal to the movement direction of the post-processing unit 33 (the width direction X).

Further, as illustrated in FIG. 16, the pressing member 91 may be urged toward the loading surface 32A of the processing tray 32. The bearing 92 is urged in the pressing direction PD, which is the direction intersecting (for example, orthogonal to) the loading surface 32A with respect to the housing 93. A first elastic member 94 is interposed between the housing 93 and the bearing 92. The first elastic member 94 is, for example, a compression spring. The first elastic member 94 urges the bearing 92, which is attached to the housing 93 in a relatively movable manner, in the pressing direction PD. In other words, the pressing member 91 is urged, by the first elastic member 94, in the pressing direction PD that is the direction approaching the loading surface 32A.

As illustrated in FIG. 16, a height dimension of a gap (an opening) between the supporting surface 47B, which supports the rear end 12R of the media bundle 12B loaded on the processing tray 32, and the pressing member 91 is set to the predetermined distance L1. In a similar manner to the first embodiment, the predetermined distance L1 is a value set on the basis of the estimated maximum load number. Note that the predetermined distance L1 is a value that can be appropriately changed depending on a design concept. This point applies to the first embodiment also.

Next, operations of the post-processing unit 33 and the pressing mechanism 90 according to the second embodiment will be described.

Figure 17:
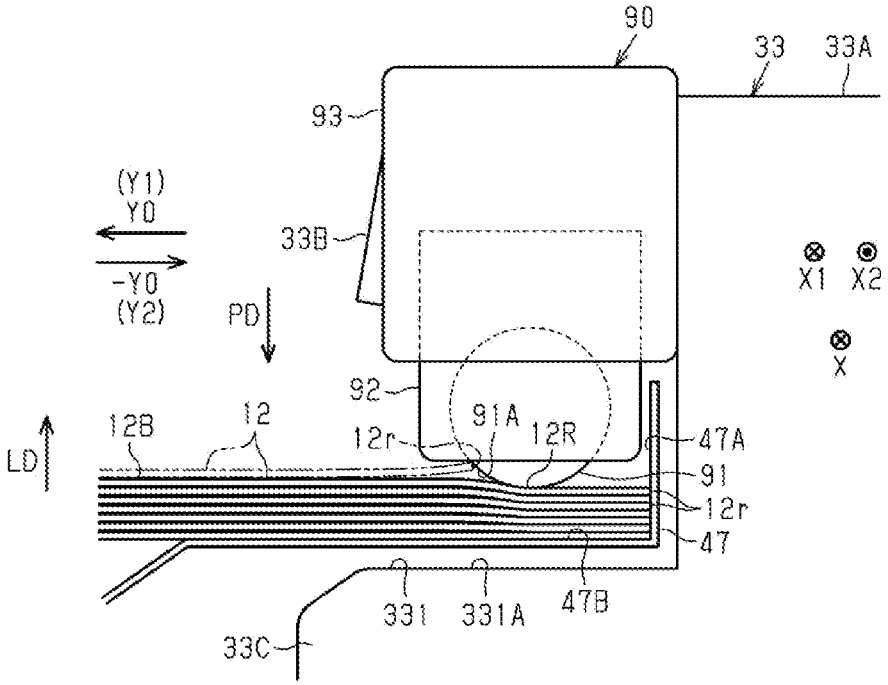
FIG. 17 is a schematic side view describing an operation of the pressing mechanism.

The medium 12 is drawn on the processing tray 32 in the upstream direction in the transport direction Y0, by the paddles 45 and 46, as illustrated in FIG. 17. The medium 12 is aligned in the transport direction Y0 as a result of the rear end 12*r* colliding with the regulating surface 47A. In the process in which the uppermost medium 12 indicated by two-dot chain lines in FIG. 17 is fed downstream in the transport direction Y0, when the rear end 12*r* comes into contact with the pressing member 91, the pressing member 91 rotates about the rotational axis parallel with the width direction X. Thus, the rear end 12*r* of the medium 12 is guided along a guide surface 91A, which is formed of the spherical surface of the rotating pressing member 91, in a direction approaching the loading surface 32A. When the rear end 12*r* of the medium 12 is guided in the direction approaching the loading surface 32A by coming into contact with the guide surface 91A formed of the spherical surface of the pressing member 91, the pressing member 91 formed of the ball rotates. Thus, compared to the first embodiment, a load applied to the medium 12 is reduced.

Then, the rear end 12*r* of the medium 12 is pushed in below the pressing member 91 formed of the ball. At this time, the medium 12 is pushed in below the pressing member 91 so as to slide along the upper surface of the uppermost medium 12 on the media bundle 12B, which has been previously stacked. Then, as a result of the rear end 12*r* of the medium 12 colliding with the regulating surface 47A, the media bundle 12B is stacked in a state in which the rear end 12R thereof is pressed by the pressing member 91.

Then, when the media 12 on the processing tray 32 have reached the target number, with respect to the media bundle 12B, the post-processing unit 33 performs the post-processing on the rear end 12R pressed by the pressing member 91. Before performing the post-processing, the post-processing unit 33 moves in the width direction X to the post-processing position. When the post-processing unit 33 moves in the width direction X, the pressing member 91 formed of the ball rotates and moves while pressing the rear end 12R of the media bundle 12B. Thus, even when the post-processing unit 33 moves to the post-processing position, the rear end 12R of the media bundle 12B can be pressed by the pressing member 91. Thus, the post-processing unit 33 can also reliably perform the post-processing in the post-processing position to which the post-processing unit 33 has moved. When the post-processing is, for example, the stapling processing, even if the medium 12 is curled, the stapling processing is performed on a pressed section of the rear end 12R of the media bundle 12B. As a result, even in a state in which the media bundle 12B has swollen due to the curling of the media 12, the stapling processing is performed on the compressed section of the rear end 12R, and thus, the occurrence of a stapling processing error in which the pin does not pierce the media bundle 12B is suppressed.

Note that, while the number of the media 12 is such that the media bundle 12B loaded on the processing tray 32 does not swell to be thicker than the predetermined distance L1 (see FIG. 16), the media bundle 12B is not pressed by the pressing member 91. On the other hand, as illustrated in FIG. 17, when the number of the media 12 exceeds the number at which the media bundle 12B loaded on the processing tray 32 swells and becomes thicker than the predetermined distance L1, the media 12 are pressed by the pressing member 91. Thus, even when the target number is small, the post-processing is performed in a state in which the height dimension of the opening is the short predetermined distance L1. As a result, compared to a configuration in which the height dimension of the opening is set to be larger than the predetermined distance L1 as the thickness of recorded media bundle 12B is expected to swell, the post-processing errors can be reduced.

According to the second embodiment, the following advantages can be achieved in addition to the advantages (1) to (10) according to the first embodiment.

(11) The pressing member 91 is spherical and is configured to be rotatable in the transport direction Y0 of the medium 12 and in the movement direction of the post-processing unit 33. Thus, it is possible to receive the medium 12 using the spherical surface, and further, the pressing member 91 can rotate when the post-processing unit 33 moves and can thinly stretch out the swelling.

Note that the above-described embodiments can be modified, as in the following modified examples. Furthermore, the above-described embodiments and the modified examples described below can be combined as appropriate to form further modified examples, or the following modified examples can be combined as appropriate to form further modified examples.

Figure 18:
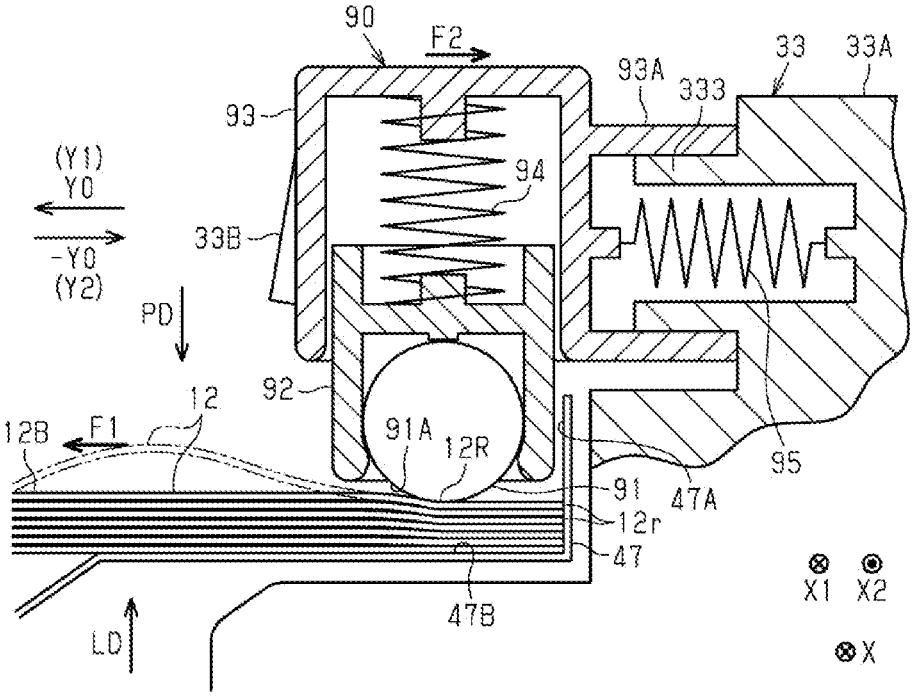
FIG. 18 is a schematic cross-sectional view illustrating the post-processing unit in which the pressing mechanism is provided, according to a modified example.

In the second embodiment, the pressing member 91 may be urged upstream in the transport direction Y0. For example, as illustrated in FIG. 18, a second elastic member 95 may be provided that urges the pressing member 91 in the upstream direction in the transport direction Y0. The second elastic member 95 urges the spherical pressing member 91 in the upstream direction in the transport direction Y0. The first elastic member 94 urges the pressing member 91 in in the pressing direction PD in the same manner as in the second embodiment. A cylindrical portion 93A extends upstream in the transport direction Y0 from the housing 93 that slidably holds the bearing 92, which rotatably holds the pressing member 91 formed of the ball. The cylindrical portion 93A is coupled to a cylindrical portion 333 that extends downstream in the transport direction Y0 from the main body 33A, such that the cylindrical portion 93A can slide in the transport direction Y0. The housing 93 is urged upstream in the transport direction Y0 by the second elastic member 95 formed of a tension spring hooked in a housing chamber on the inside of the cylindrical portion 93A and the cylindrical portion 333.

When the rear end 12*r* of the medium 12 is bent due to the reaction when colliding with the regulating surface 47A, the force F1 that releases the bending is generated downstream in the transport direction Y0. However, in this modified example, when the uppermost medium 12 in contact with the pressing member 91 attempts to shift downstream in the transport direction Y0 as a result of the force F1, the force F2 resulting from the urging force of the second elastic member 95, which obstructs that displacement, acts on the uppermost medium 12. As a result, the position shift of the medium 12 downstream in the transport direction Y0 due to the reaction force when the rear end 12*r* collides with the regulating surface 47A is suppressed. Thus, the medium 12 is aligned in the transport direction Y0 with almost no deviation. As a result, the post-processing can be performed on the media bundle 12B aligned with a high degree of alignment in the transport direction Y0.

Note that in the example illustrated in FIG. 18, the second elastic member 95 is the tension spring, but the second elastic member 95 may be a compression spring that is disposed at a position downstream of the bearing 92 or the housing 93 in the transport direction Y0, and urges the bearing 92 or the housing 93 upstream in the transport direction Y0.

In the first embodiment or the modified example illustrated in FIG. 18, in place of the configuration in which the two types of elastic member, namely, the first elastic member 94 and the second elastic member 95, are provided, a configuration may be adopted in which one type of elastic member is provided that urges the pressing member 81, 91 in a direction composed of two direction components, namely, the pressing direction PD and the upstream direction in the transport direction Y0. By providing this urging structure, the pressing force of the media bundle 12B and the suppression of the misalignment of the medium 12 in the transport direction Y0 can both be achieved using the single elastic member.

Figure 19:
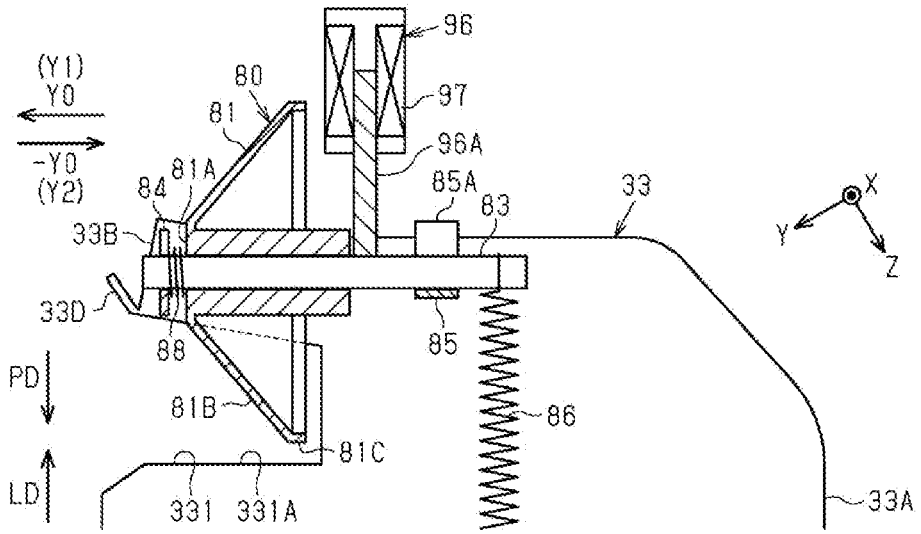
FIG. 19 is a schematic side view illustrating the pressing mechanism and the post-processing unit according to a modified example.

The pressing member 81, 91 may be provided so as to be able to separate from the medium 12. For example, the pressing member 81 according to the first embodiment may be moved between a position where the pressing member 81 is in contact with and presses the medium 12, and a position where the pressing member 81 is separated from the medium 12, using an actuator (drive source) such as a plunger. As illustrated in FIG. 19, the pressing member 81 may be provided so as to be movable, using a plunger 96, in a direction intersecting the loading surface. The plunger 96 movably supports the support shaft 83 in a direction intersecting the loading surface 32A. The plunger 96 is provided with a driving rod 96A fixed to the support shaft 83, and an electromagnet 97 that moves the pressing member 81 using an attractive force of an electromagnetic force in a separating direction opposite to the urging direction of the first elastic member 86. By controlling the plunger 96, the control unit 110 controls the position of the pressing member 81 in the pressing direction PD.

Figure 20:
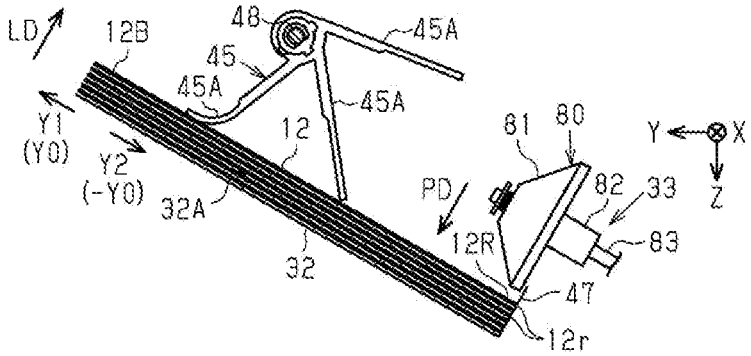
FIG. 20 is a schematic side view illustrating a medium alignment process.
Figure 21:
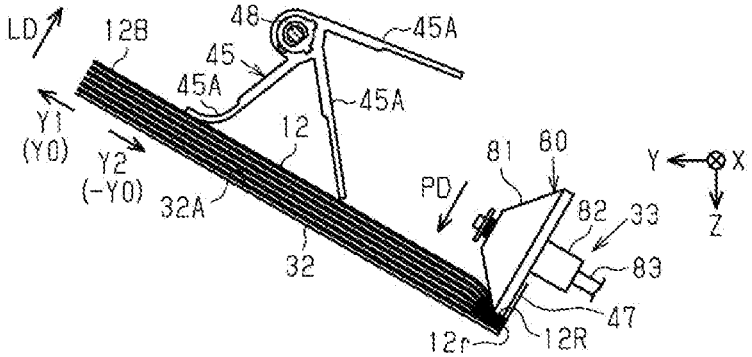
FIG. 21 is a schematic side view illustrating the medium alignment process.

As illustrated in FIG. 20, in the alignment process in which the medium 12 is aligned by the rear end alignment unit 47, the pressing member 81 stands by at a separated position in which the pressing member 81 is separated from the medium 12, as a result of the driving of the plunger 96 (see FIG. 19). Further, as illustrated in FIG. 21, during a period from when the alignment of one of the media 12 is complete until the alignment of the next medium 12 starts, and when the post-processing on the media 12 is being performed, the pressing member 81 moves in the pressing direction PD and presses the media 12.

Specifically, during a period from when the drawing of the medium 12 by the drawing member, such as the paddle 45, starts to when the rear end 12*r* of the medium 12 collides with the regulating surface 47A, the pressing member 81 is retracted at the separated position (FIG. 20). The control unit 110 calculates this period of time using a medium length, which is the length of the medium 12 in the transport direction Y0, and the rotation amount of the paddle 45. The control unit 110 moves the pressing member 81 from the separated position to the pressing position when the alignment of the rear end 12*r* of one of the media 12 is complete as a result of colliding with the regulating surface 47A. As a result, each time the alignment of one of the media 12 is completed, the rear end 12R of the media bundle 12B is pressed by the pressing member 81 that has moved to the pressing position. The rear end 12R of the media bundle 12B is held in the compressed state by the pressing member 81 in the pressing position until the drawing of the next medium 12 is started. Then, when the target number of the media 12 are stacked on the processing tray 32, and the media bundle 12B is complete, the pressing member 81 moves from the retracted position to the pressing position, and presses the rear end 12R of the media bundle 12B. Then, in the state in which the pressing member 81 is pressing the rear end 12R, the post-processing unit 33 performs the post-processing on the rear end 12R. According to this configuration, the pressing member 81 is separated from the medium 12 during the process of aligning the medium 12 on the processing tray 32, and thus, the medium 12 can be transported without resistance until the medium 12 collides with the rear end alignment unit 47. In addition, the same effects (1) to (10) are obtained as in the first embodiment. Note that, with respect to the pressing member 91 of the second embodiment also, the housing 93 may be provided to be movable in a direction parallel to the pressing direction PD, and the actuator (the drive source) may be used to move the pressing member 91 between the separated position and the pressing position in a similar manner to the first embodiment. Further, the actuator may also be an electric motor.

The pair of pressing members 81 are provided at the positions on both sides of where the post-processing is performed (the recessed portion), but only one of the pressing members 81 may be provided. Further, three or more of the pressing members 81 may be provided.

The pressing member 81 may be rotated by the power of a drive source such as an electric motor.

The pressing member 81 may have another shape, as long as the pressing member 81 has a shape that can rotate about the rotational axis line RL. For example, when the configuration illustrated in FIG. 19 to FIG. 21 is adopted, the pressing member 81 may be a cylindrical roller.

In each of the embodiments described above, the predetermined distance L1, which is the distance in the loading direction LD between the pressing member 81, 91 and the supporting surface 47B, is set to a thickness corresponding to the maximum load number of the unrecorded media 12, but the predetermined distance L1 may be set to a distance other than that. For example, the predetermined distance L1 may be a distance corresponding to a thickness of half the maximum load number of the unrecorded media 12. Further, the predetermined distance L1 may also be "0". In these cases, it is sufficient that the pressing member 81, 91 be able to move in the loading direction LD until the predetermined distance L1 is at least the distance corresponding to the maximum load number. Further, in these cases, as long as the set number is a number of sheets equal to or greater than half the maximum load number, the rear end 12R of the media bundle 12B can be pressed by the pressing member 81, 91. Thus, compared to each of the embodiments described above, a frequency at which the rear end 12R of the media bundle 12B is pressed by the pressing member 81, 91 is increased, and the post-processing errors can thus be further reduced. Furthermore, when the predetermined distance L1 is "0", irrespective of the set number, the rear end 12R of the media bundle 12B can be pressed when the post-processing unit 33 moves and at the time of the post-processing, and the post-processing errors can thus be even further reduced.

The alignment portion is not limited to the rear end alignment portion that aligns the rear end of the medium. For example, the processing tray 32 may be arranged with an inclination that is opposite to that in each of the embodiments described above, that is, an inclination in which the position thereof lowers the further downstream in the transport direction Y0. Then, the alignment portion may be a tip alignment portion that aligns a tip 12*f* of the medium 12 in the processing tray 32 by colliding with the tip 12*f*. With such a configuration, the post-processing unit 33 may perform the post-processing on the tip portion of the medium 12 aligned by the tip alignment portion. Further, when the post-processing unit 33 is configured to perform the post-processing on the tip portion of the medium 12, the pressing member may press the tip portion of the medium.

The second elastic member 88, 95 that urges the pressing member 81, 91 upstream in the transport direction Y0 may be a spring other than the coil spring. For example, it may be a plate spring such as a washer spring or a disc spring. For example, a plate spring may be interposed between the top portion 81A of the pressing member 81 and the first arm 84 that supports the tip of the support shaft 83, such that the pressing member 81 is urged upstream in the transport direction Y0.

The first elastic member 86 may be a compression spring, as long as the pressing member 81 can be urged in the pressing direction PD toward the loading surface 32A. The first elastic member 86 may be a compression spring that urges the support shaft 83 from an upper position thereof in the pressing direction PD, for example.

The second elastic member 88 may be a tension spring, as long as the pressing member 81 can be urged in the upstream direction in the transport direction Y0.

The first elastic member 86 may be a member other than a spring. Further, the second elastic member 88 may be a member other than a spring. For example, the first elastic member 86 may be an elastic member, such as rubber, that urges the pressing member 81 upstream in the transport direction Y0. Further, for example, the second elastic member 88 may be an elastic member, such as rubber, that urges the pressing member 81 in the pressing direction approaching the loading surface 32A.

The first elastic member 86 and the second elastic member 88 need not necessarily be provided.

The post-processing unit 33 and the pressing member 81 are configured to be integrated, but the pressing member 81 and the post-processing unit 33 may be configured separately. For example, a configuration may be adopted in which the pressing member 81 and the post-processing unit 33 move on different rails from each other, and the pressing member 81 moves together with the movement of the post-processing unit 33. In this configuration, the respective drive sources of the post-processing unit 33 and the pressing member 81 may be different or may be the same.

The receiving mechanism 41 for receiving the medium 12 in the tray 32 is not limited to the configuration of being provided with the variable guide 42. For example, the receiving mechanism 41 may be a suction transport belt that transports the medium 12 while sucking the belt. Examples of a suction method using the suction transport belt include negative pressure, static electricity, and the like. In this case, after the suction transport belt has sucked the medium 12 discharged from the transport mechanism 30 in the transport direction Y0 toward the upper position of the processing tray 32, and has transported the medium 12 to the upper position of the processing tray 32, the medium 12 may be received on the processing tray 32 by causing the suction to be released or the medium 12 to be forcibly peeled from the suction transport belt using a movable guide or the like, and causing the medium 12 to be dropped onto the loading surface 32A. Further, after transporting the medium 12 sucked by the suction transport belt in the transport direction Y0, a movement direction of the belt is reversed, so that the medium 12 is transported in a switched back manner in the reverse transport direction −Y0. Then, the medium 12 may be received on the processing tray 32 by peeling the medium 12 from the suction transport belt in the process of being transported in the reverse transport direction −Y0, or by releasing the suction of the medium 12 and dropping the medium 12 onto the loading surface 32A.

The intermediate device 15 need not necessarily be provided in the recording system 11. In other words, the recording system 11 may be configured by the recording device 13 and the post-processing device 14. Further, the inversion processing unit 200 of the intermediate device 15 may also be incorporated into the post-processing device 14. In this case, after internally inverting the medium 12 transported from the recording device 13, the post-processing device 14 causes the medium 12 to be received on the tray 32, and performs the post-processing. Further, the inversion processing unit 200 of the intermediate device 15 may also be incorporated into the recording device 13. In this case, the post-processing device 14 causes the medium 12 transported from the recording device 13 after inversion to be housed in the tray 32, and performs the post-processing.

In the above-described embodiments, the recording system 11 has the configuration provided with the recording device 13 and the post-processing device 14, but the recording device 13 may be provided with the post-processing device 14.

The recording device 13 and the post-processing device 14 may be a recording system housed within one housing. For example, the recording system may be configured to house the post-processing device 14 in the housing of the recording device 13. Further, the recording system may be configured to house the inversion processing unit 200 and the post-processing device 14 in the housing of the recording device 13. The post-processing device 14 may be housed in the intermediate device 15.

The control unit 110 may be configured by software by which a computer, such as a CPU or the like, executes a program, or may be configured by hardware configured by an electronic circuit such as an ASIC. Further, the control unit 110 may be configured by software and hardware operating in conjunction.

The medium 12 is not limited to the sheet, and may be a film or medium made of synthetic resin, a cloth, a non-woven fabric, a laminate medium, or the like.

The recording device 13 is not limited to the inkjet type printer, and may be an inkjet type fabric printing device. Further, in addition to the recording function, the recording device 13 may be a multifunction device having a scanner mechanism and a copy function.

The recording method of the recording device 13 is not limited to the inkjet method, and may be a dot impact type, an electrophotographic type, and a heat-transfer type.

Hereinafter, technical concepts and effects that are understood from the above-described embodiments and modified examples will be described.

(A) The post-processing device includes the processing tray onto which is loaded the medium on which recording was performed by the recording unit, the alignment unit configured to align the end portion of the medium on the processing tray, the post-processing unit configured to perform the post-processing on the medium aligned by the alignment unit, and the pressing member configured to press the end portion of the medium. The post-processing unit is configured to move, and the pressing member is configured to move in conjunction with the movement of the post-processing unit, in a state where the pressing member is in contact with the medium aligned by the alignment unit.

According to this configuration, when the post-processing unit moves, the pressing member thinly stretches out the swelling of the medium as a result of being in contact with the medium, and thus, the post-processing is performed on the end portion at which the swelling of the medium is suppressed. As a result, the quality of the post-processing on the medium that has curled can also be improved. Thus, the post-processing can be performed on the medium in a state in which the swelling of the medium has been stretched out, and the quality of the post-processing is improved.

(B) In the post-processing device described above, the pressing member may include the rotational axis in the direction orthogonal to the movement direction of the post-processing unit, and the pressing member may be configured to rotate in conjunction with the movement of the post-processing unit.

According to this configuration, since the pressing member is in contact with the medium while rotating when the post-processing unit moves, it is possible to prevent scratches when thinly stretching out the swelling of the medium.

(C) In the above-described post-processing device, the pressing member may form the conical shape and may include the top portion facing upstream in the transport direction of the medium. The pressing member may be configured to rotate about the rotational axis, the rotational axis passing through the top portion. Note that the conical shape may include the cone and the truncated cone.

According to this configuration, the rear end of the medium abuts the conical surface of the pressing member forming the conical shape, and the rear end is guided along the conical surface toward the outer peripheral end surface that has the maximum diameter of the pressing member. As a result, the rear end of the medium is pressed by the outer peripheral end portion of the pressing member. Thus, when aligning the medium, the medium can be moved without resistance to the location to be pressed by the pressing member, and further, when the post-processing unit moves, the pressing member can rotate and thinly stretch out the swelling of the medium. As a result, the location of the post-processing of the medium can be reliably pressed. Thus, the post-processing can be performed on the location, of the medium 12, that has been thinly stretched out.

(D) In the post-processing device described above, the pressing member may be spherical and may be configured to rotate in the transport direction of the medium and in the movement direction of the post-processing unit. According to this configuration, when aligning the medium, the medium can be moved without resistance by the spherical surface to the location to be pressed by the pressing member, and further, when the post-processing unit moves, the pressing member can rotate and thinly stretch out the swelling.

(E) In the post-processing device described above, the pressing member may be provided on both sides in the movement direction of the post-processing unit.

According to this configuration, whichever direction the post-processing unit moves in, the pressing member presses an advance position in that direction while rotating, and it is thus possible to reliably thinly stretch out the swelling of the medium 12 at the location at which the post-processing is performed.

(F) In the above-described post-processing device, the pressing member may be urged toward the loading surface of the processing tray.

According to this configuration, the swelling of the medium can be thinly stretched out, and the aligned medium can be held without any position shift.

(G) In the above-described post-processing device, the pressing member may be urged upstream in the transport direction of the medium.

According to this configuration, even if the aligned medium attempts to move downstream in the transport direction due to the reaction force, the medium is subject to a force from the pressing member in a direction opposite to that movement direction, and it is thus possible to suppress a position shift of the medium from the aligned position.

(H) In the above-described post-processing device, the pressing member may be provided separably from the medium. The pressing member may be separated from the medium when the medium is being aligned by the alignment unit, and the pressing member may be in contact with the medium when the post-processing unit moves and when the post-processing is performed on the medium.

According to this configuration, by separating the pressing member from the medium when the medium is being aligned, the medium can be aligned by the rear end alignment unit without resistance, and further, the post-processing can be performed at the location, of the medium, at which the swelling has been thinly stretched out.

What is claimed is:

1. A post-processing device comprising:

a processing tray at which is loaded a medium on which recording was performed by a recording unit;

an alignment unit configured to align an end portion of the medium at the processing tray; and a post-processing unit configured to perform stapling on the medium aligned by the alignment unit, and including two pressing members configured to press the end portion of the medium, each pressing member being disposed on one of both sides of the post-processing unit, wherein the post-processing unit and the pressing members are configured to integrally move, in a state where the pressing members are in contact with the medium aligned by the alignment unit.

2. The post-processing device according to claim 1, wherein the pressing members include a rotational axis extending in a direction orthogonal to a movement direction of the post-processing unit, and the pressing members are configured to rotate in conjunction with the movement of the post-processing unit.

3. The post-processing device according to claim 2, wherein the pressing members form a conical shape and includes a top portion facing upstream in a transport direction of the medium, and the pressing members are configured to rotate about the rotational axis passing through the top portion.

4. The post-processing device according to claim 1, wherein the pressing members are spherical, and the pressing members are provided rotatably in a transport direction of the medium and in a movement direction of the post-processing unit.

5. The post-processing device according to claim 1, wherein the pressing members are provided on both of sides in a movement direction of the post-processing unit.

6. The post-processing device according to claim 1, wherein the pressing members are pressed toward a loading surface of the processing tray.

7. The post-processing device according to claim 1, wherein the pressing members are pressed upstream in a transport direction of the medium.

8. The post-processing device according to claim 1, wherein the pressing members are provided separably from the medium, the pressing members are separated from the medium when the medium is being aligned by the alignment unit, and the pressing members are in contact with the medium when the post-processing unit moves and when the stapling is performed on the medium.

9. The post-processing device according to claim 1, wherein the pressing members are provided on both sides of the post-processing unit.

10. A post-processing device comprising:

a processing tray at which is loaded a medium on which recording was performed by a recording unit;

an alignment unit configured to align an end portion of the medium at the processing tray; and a post-processing unit configured to perform punching on the medium aligned by the alignment unit, and including two pressing members configured to press the end portion of the medium, each pressing member being disposed on one of both sides of the post-processing unit, wherein the post-processing unit and the pressing members are configured to integrally move, in a state where the pressing members are in contact with the medium aligned by the alignment unit.

* * * * *